US010704371B2

(12) United States Patent
Dieckmann et al.

(10) Patent No.: US 10,704,371 B2
(45) Date of Patent: Jul. 7, 2020

(54) LOW DIELECTRIC ZONE FOR HYDROCARBON RECOVERY BY DIELECTRIC HEATING

(71) Applicant: Chevron U.S.A. Inc., San Ramon, CA (US)

(72) Inventors: Gunther H. Dieckmann, Walnut Creek, CA (US); Michal Mieczyslaw Okoniewski, Calgary (CA); Cesar Ovalles, Walnut Creek, CA (US); Pedro Vaca, Calgary (CA); James Dunlavey, Bakersfield, CA (US); Donald Kuehne, Hercules, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 112 days.

(21) Appl. No.: 15/783,640

(22) Filed: Oct. 13, 2017

(65) Prior Publication Data

US 2019/0112906 A1 Apr. 18, 2019

(51) Int. Cl.
*E21B 43/24* (2006.01)
*E21B 33/13* (2006.01)
(Continued)

(52) U.S. Cl.
CPC ..... *E21B 43/2401* (2013.01); *E21B 33/13* (2013.01); *E21B 33/14* (2013.01); *E21B 7/28* (2013.01)

(58) Field of Classification Search
CPC ... E21B 43/2401; E21B 43/2635; E21B 36/04
See application file for complete search history.

(56) References Cited

U.S. PATENT DOCUMENTS 3,104,711 A * 9/1963 Haagensen ..... E21B 36/04 166/60
3,170,519 A 2/1965 Haagensen
(Continued)

FOREIGN PATENT DOCUMENTS

CA 2933893 A1 * 12/2016 ..... E21B 43/2401

OTHER PUBLICATIONS

Cerutti et al. "A New Technique for Heavy Oil Recovery Based on Electromagnetic Heating: System Design and Numerical Modeling" 2013, Chemical Engineering Transaction—AIDIC, vol. 32, p. 1255-1260 (Year: 2013).*

(Continued)

*Primary Examiner* — Jennifer H Gay

(57) ABSTRACT

Embodiments include drilling a wellbore in a hydrocarbon-bearing formation, and the wellbore includes a radio frequency antenna destination portion that is configured to receive a radio frequency antenna; forming a low dielectric zone in the hydrocarbon-bearing formation proximate to the radio frequency antenna destination portion with a cavity based process or a squeezing based process; positioning the radio frequency antenna into the radio frequency antenna destination portion such that the radio frequency antenna is proximate to the low dielectric zone; dielectric heating the hydrocarbon-bearing formation with the radio frequency antenna such that the low dielectric zone increases dissipation of energy from the radio frequency antenna into the hydrocarbon-bearing formation; and extracting hydrocarbons from the heated hydrocarbon-bearing formation. The material has a dielectric constant of less than or equal to 20, a loss tangent of less than or equal to 0.4, and a porosity of less than or equal to 5%.

24 Claims, 10 Drawing Sheets

(51) Int. Cl.
*E21B 33/14* (2006.01)
*E21B 7/28* (2006.01)

(56) References Cited

U.S. PATENT DOCUMENTS 4,140,180 A 2/1979 Bridges et al.
4,485,868 A 12/1984 Sresty et al.
4,485,869 A 12/1984 Sresty et al.
4,620,593 A 11/1986 Haagensen
4,817,711 A 4/1989 Jeambey
4,912,971 A 4/1990 Jeambey
5,065,819 A * 11/1991 Kasevich ..... E21B 36/04 166/248
5,152,341 A * 10/1992 Kasevich ..... B09C 1/062 166/248
5,293,936 A 3/1994 Bridges
7,055,599 B2 * 6/2006 Kasevich ..... E21B 43/006 166/248
7,312,428 B2 12/2007 Kinzer
7,441,597 B2 10/2008 Kasevich
7,891,421 B2 2/2011 Kasevich
7,922,895 B2 4/2011 Banerjee
7,934,549 B2 5/2011 Cimolai
7,975,763 B2 7/2011 Banerjee et al.
8,128,786 B2 3/2012 White et al.
8,133,384 B2 3/2012 Parsche
8,337,769 B2 12/2012 Parsche
8,365,823 B2 2/2013 Dreher, Jr. et al.
8,443,887 B2 5/2013 Parsche
8,453,739 B2 6/2013 Parsche
8,464,789 B2 6/2013 Banerjee et al.
8,555,970 B2 10/2013 Wheeler et al.
8,656,998 B2 2/2014 Dong et al.
8,701,760 B2 4/2014 Parsche et al.
8,720,547 B2 * 5/2014 Banerjee ..... E21B 43/2408 166/248
8,720,549 B2 5/2014 Banerjee et al.
8,763,692 B2 7/2014 Parsche
8,978,755 B2 3/2015 Sultenfuss et al.
9,004,164 B2 4/2015 Dreher et al.
9,157,305 B2 10/2015 Dittmer et al.
9,267,365 B2 2/2016 Dittmer et al.
9,284,826 B2 3/2016 Campbell et al.
9,297,240 B2 3/2016 Sultenfuss et al.
9,453,400 B2 * 9/2016 Wheeler ..... E21B 43/24
9,474,108 B2 10/2016 Hann et al.
9,598,945 B2 3/2017 Okoniewski et al.
9,653,812 B2 * 5/2017 Okoniewski ..... H01Q 9/28
2005/0199386 A1 * 9/2005 Kinzer ..... E21B 43/2401 166/248
2008/0271885 A1 * 11/2008 Kaminsky ..... E21B 36/04 166/245
2010/0089584 A1 * 4/2010 Burns ..... E21B 43/2401 166/302
2011/0192598 A1 * 8/2011 Roddy ..... E21B 33/13 166/253.1
2011/0224109 A1 * 9/2011 Ali ..... C04B 24/14 507/131
2012/0097395 A1 * 4/2012 McClung, III ..... C04B 40/0209 166/285
2012/0234537 A1 * 9/2012 Sultenfuss ..... E21B 43/2408 166/272.3
2012/0321526 A1 12/2012 Hernandez et al.
2012/0325458 A1 * 12/2012 El-Rabaa ..... E21B 43/2401 166/248
2013/0008651 A1 1/2013 Trautman et al.
2013/0112403 A1 * 5/2013 Meurer ..... E21B 43/2401 166/248
2013/0248185 A1 * 9/2013 Parsche ..... E21B 36/04 166/302
2014/0102692 A1 * 4/2014 Parsche ..... E21B 43/20 166/248
2014/0182845 A1 * 7/2014 Roberson ..... E21B 33/13 166/250.07
2014/0224472 A1 * 8/2014 Parsche ..... H01Q 9/16 166/60
2015/0034304 A1 * 2/2015 Parsche ..... E21B 43/2401 166/248
2015/0129224 A1 5/2015 Wright et al.
2015/0300141 A1 * 10/2015 Malot ..... E21B 43/2401 166/302
2015/0322759 A1 * 11/2015 Okoniewski ..... H01Q 1/04 166/60
2015/0345268 A1 * 12/2015 Bryant ..... E21B 43/164 166/271
2015/0354333 A1 * 12/2015 Kasevich ..... E21B 47/09 166/247
2016/0272878 A1 * 9/2016 McDaniel ..... C09K 8/035
2016/0326839 A1 * 11/2016 Ayub ..... E21B 47/065
2016/0376883 A1 * 12/2016 Diecknnann ..... E21B 43/2401 166/265
2017/0226835 A1 * 8/2017 De Simoni ..... E21B 43/2401
2017/0260843 A1 * 9/2017 Ersoz ..... E21B 43/267
2017/0370197 A1 * 12/2017 Han ..... E21B 43/26
2019/0024488 A1 * 1/2019 Filatyev ..... E21B 43/2401
2019/0048685 A1 * 2/2019 Batarseh ..... E21B 36/005
2019/0112906 A1 * 4/2019 Dieckmann ..... E21B 33/13
2019/0338625 A1 * 11/2019 Othman ..... E21B 43/26

OTHER PUBLICATIONS

"Standard Test Methods for AC Loss Characteristics and Permittivity (Dielectric Constant) of Solid Electrical Insulation"; An American National Standard issued under the fixed designation of D° 150 (1998), (Reapproved in 2004), p. 1-20.

Bientinesi, Matteo, et al.; "A New Technique for Heavy Oil Recovery Based on Electromagnetic Heating: Pilot Scale Experimental Validation"; Chemical Engineering Transactions, vol. 32, (2013), pp. 2287-2292.

Bientinesi, Matteo, et al.; "A Radiofrequency/Microwave Heating Method for Thermal Heavy Oil Recovery Based on a Novel Tight-Shell Conceptual Design"; Journal of Petroleum Science and Engineering, vol. 107, (2013), pp. 18-30.

Bona, Nicola, et al.; "Electrical Measurements in the 100 Hz to 10 GHz Frequency Range for Efficient Rock Wettability Determination"; Society of Petroleum Engineers Journal, Mar. 2001, pp. 80-88.

Cerutti, Alessandro, et al.; "A New Technique for Heavy Oil Recovery Based on Electromagnetic Heating: System Design and Numerical Modelling"; Chemical Engineering Transactions, vol. 32, (2013), pp. 1255-1260.

Kasevich, R.S., et al.; "Pilot Testing of a Radio Frequency Heating System for Enhanced Oil Recovery from Diatomaceous Earth"; SPE 28619, Sep. 1994, pp. 105-113, drawings (5 pages), and a Corrections and Clarifications page.

Sahni, Akshay, et al.; "Electromagnetic Heating Methods for Heavy Oil Reservoirs"; SPE 62550, Jun. 2000, pp. 1-10.

Smithson, Tony (Editor); "How Porosity is Measured"; Oilfield Review, vol. 24, No. 3, (2012), pp. 63-64.

* cited by examiner

LOW DIELECTRIC ZONE FOR HYDROCARBON RECOVERY BY DIELECTRIC HEATING

TECHNICAL FIELD

The disclosure relates to methods and systems for dielectric heating of a hydrocarbon-bearing formation using a radio frequency antenna.

BACKGROUND

One technique for recovering hydrocarbons (also referred to as producing hydrocarbons or hydrocarbon production) from a hydrocarbon-bearing formation involves the drilling of a wellbore into the hydrocarbon-bearing formation and pumping the hydrocarbons, such as oil, out of the formation. In many cases, however, the oil is too viscous under the formation conditions, and thus adequate oil flow rates cannot be achieved with this technique.

Radio frequency antennas have been utilized to heat the viscous oil and reduce its viscosity. For example, numerous investigators have published research results on using electromagnetic methods to produce the hydrocarbons from the hydrocarbon-bearing formation. However, the application of electromagnetic methods to subsurface formations has generally been plagued by uneven heating, including excessive heating, near the wellbore, which may lead to damage to the wellbore, damage to the radio frequency antenna, or any combination thereof.

Some attention has been paid to the problem of non-uniform heating by electromagnetic methods. For example, U.S. Pat. No. 5,293,936 attempted to resolve the uneven heating problem when using a monopole or dipole antenna-like apparatus by modifying edge and power input regions to purportedly achieve equal distribution of electric fields. U.S. Pat. No. 7,312,428 suggested switching out different electrode element pairs for moments of time or possibly providing different field strengths to different portions of the formation or stratification to achieve more uniform heating of the formation. Each of these patents is incorporated by reference in its entirety.

Bientinesi et al. (M. Bientinesi, L. Petarca, A. Cerutti, M. Bandinelli, M. De Simoni, M. Manotti, G. Maddinelli, J. Pet. Sci. Eng., 107, 18-30, 2013), which is incorporated by reference in its entirety, carried out experimental work and numerical simulation of radio frequency (RF)/microwave (MW) heating using quartz sand as a low RF absorbance material. The authors heated oil-containing sand to 200° C. using a dipolar radio frequency antenna irradiating at 2.45 GHz. Their lab and modelling results showed that the presence of the quartz sand around the antenna lowered the temperature in this critical zone and better distributed the irradiated energy in the oil sand. However, the use of sand or other similar porous solids alone as low RF absorbance material do not work properly because of their tendency to become water-wet during the days and months of dielectric heating. An increase of water saturation leads to an increase in the RF absorption properties which, in turn, may still lead to excessive heating causing damage to the wellbore, damage to the radio frequency antenna, or any combination thereof.

There is still a need for an improved manner of using a radio frequency antenna for hydrocarbon recovery that addresses the excessive heating challenge.

SUMMARY

Various embodiments of recovering hydrocarbons from a hydrocarbon-bearing formation using a radio frequency antenna are provided. In one embodiment, a method of recovering hydrocarbons from a hydrocarbon-bearing formation using a radio frequency antenna comprises drilling a wellbore in a hydrocarbon-bearing formation. The wellbore includes a radio frequency antenna destination portion that is configured to receive a radio frequency antenna. The method further includes placing a low porosity-low dielectric material in the hydrocarbon-bearing formation proximate to the radio frequency antenna destination portion to form a low dielectric zone. The low porosity-low dielectric material has a dielectric constant of less than or equal to 20, a loss tangent of less than or equal to 0.4, and a porosity of less than or equal to 5%. The method further includes positioning the radio frequency antenna into the radio frequency antenna destination portion such that the radio frequency antenna is proximate to the low dielectric zone in the hydrocarbon-bearing formation. The method further includes dielectric heating the hydrocarbon-bearing formation with the radio frequency antenna such that the low dielectric zone increases dissipation of energy from the radio frequency antenna into the hydrocarbon-bearing formation. The method further includes extracting hydrocarbons from the heated hydrocarbon-bearing formation.

In one embodiment, an apparatus for recovering hydrocarbons from a hydrocarbon-bearing formation comprises a radio frequency antenna adapted to be positioned in a radio frequency antenna destination portion of a wellbore in a hydrocarbon-bearing formation. The apparatus further includes a low porosity-low dielectric material that is positioned proximate to the radio frequency antenna and having a dielectric constant of less than or equal to 20, a loss tangent of less than or equal to 0.4, and a porosity of less than or equal to 5%. The low porosity-low dielectric material being capable of forming a low dielectric zone in the hydrocarbon-bearing formation when the radio frequency antenna is activated to increase the dissipation of energy from the radio frequency antenna into the hydrocarbon-bearing formation.

BRIEF DESCRIPTION OF THE FIGURES

Other features described herein will be more readily apparent to those skilled in the art when reading the following detailed description in connection with the accompanying drawings, wherein.

Figure 1:
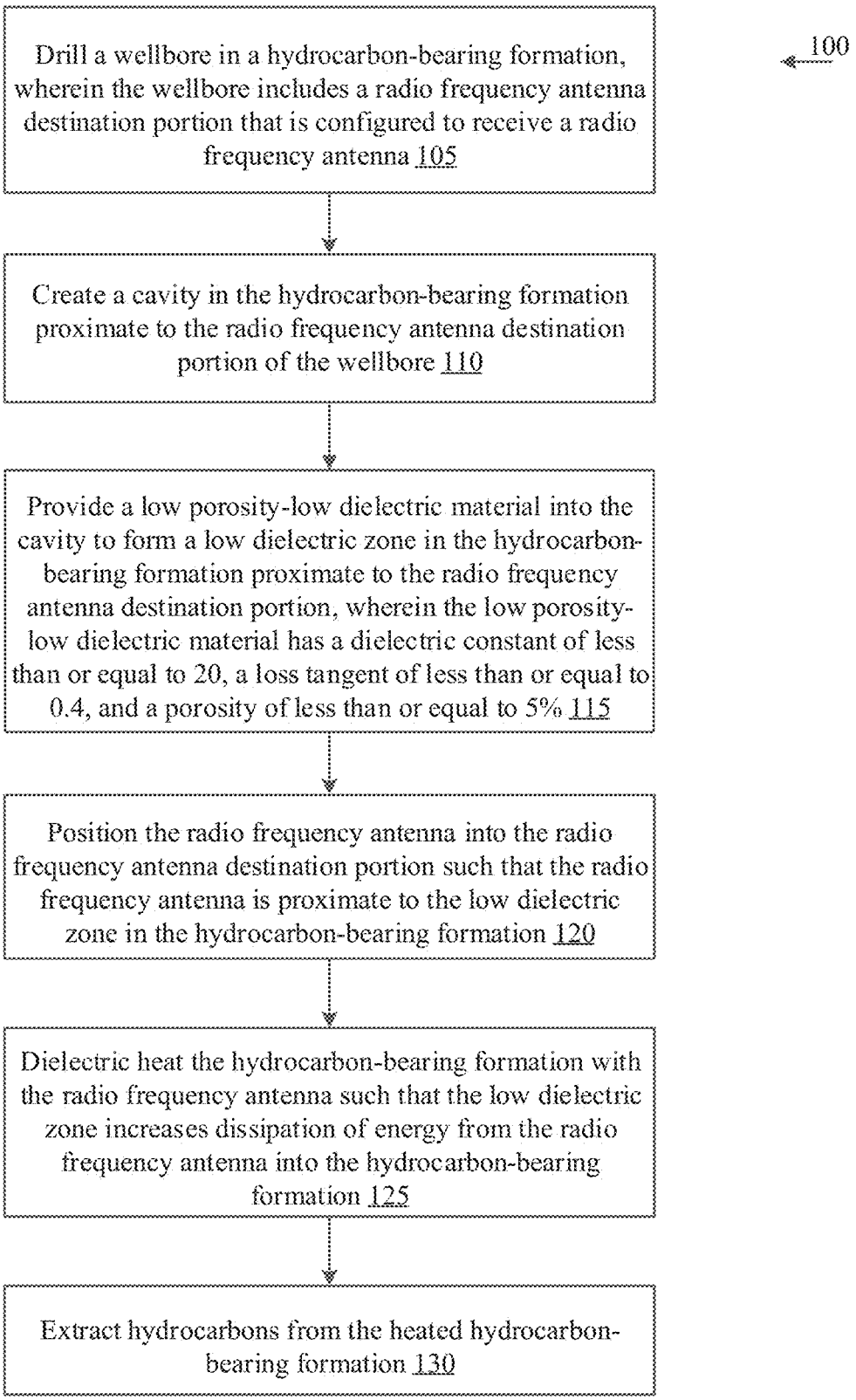
FIG. 1 illustrates one embodiment of a method of recovering hydrocarbons from a hydrocarbon-bearing formation using a radio frequency antenna.

The figures, embodiments, and examples provided herein are not necessarily drawn to scale, and instead, the emphasis has been placed upon clearly illustrating the principles of the present disclosure. Moreover, in the figures, like reference numerals designate corresponding parts throughout the several views.

DETAILED DESCRIPTION

Terminology

The following terms will be used throughout this disclosure and will have the following meanings unless otherwise indicated:

"Hydrocarbon-bearing formation" or simply "formation" refer to the rock matrix in which a wellbore may be drilled. For example, a formation refers to a body of rock that is sufficiently distinctive and continuous such that it can be mapped. It should be appreciated that while the term "formation" generally refers to geologic formations of interest, that the term "formation," as used herein, may, in some instances, include any geologic points or volumes of interest (such as a survey area).

The formation may include faults, fractures (e.g., naturally occurring fractures, fractures created through hydraulic fracturing, etc.), geobodies, overburdens, underburdens, horizons, salts, salt welds, etc. The formation may be onshore, offshore (e.g., shallow water, deep water, etc.), etc. Furthermore, the formation may include hydrocarbons, such as liquid hydrocarbons (also known as oil or petroleum), gas hydrocarbons, a combination of liquid hydrocarbons and gas hydrocarbons, etc.

One measure of the heaviness or lightness of a liquid hydrocarbon is American Petroleum Institute (API) gravity. According to this scale, light crude oil is defined as having an API gravity greater than 31.1° API (less than 870 kg/m3), medium oil is defined as having an API gravity between 22.3° API and 31.1° API (870 to 920 kg/m3), heavy crude oil is defined as having an API gravity between 10.0° API and 22.3° API (920 to 1000 kg/m3), and extra heavy oil is defined with API gravity below 10.0° API (greater than 1000 kg/m3). Light crude oil, medium oil, heavy crude oil, and extra heavy oil are examples of hydrocarbons. Indeed, examples of hydrocarbons may be conventional oil, natural gas, kerogen, bitumen, heavy oil, clathrates (also known as hydrates), or any combination thereof.

The hydrocarbons may be recovered from the formation using primary recovery (e.g., by relying on pressure to recover hydrocarbons), secondary recovery (e.g., by using water injection or natural gas injection to recover hydrocarbons), enhanced oil recovery (EOR), or any combination thereof. The term "enhanced oil recovery" refers to techniques for increasing the amount of hydrocarbons that may be extracted from the formation. Enhanced oil recovery may also be referred to as improved oil recovery or tertiary oil recovery (as opposed to primary and secondary oil recovery).

Examples of EOR operations include, for example, (a) miscible gas injection (which includes, for example, carbon dioxide flooding), (b) chemical injection (sometimes referred to as chemical enhanced oil recovery (CEOR), and which includes, for example, polymer flooding, alkaline flooding, surfactant flooding, conformance control operations, as well as combinations thereof such as alkaline-polymer flooding, surfactant-polymer (SP) flooding, or alkaline-surfactant-polymer flooding), (c) microbial injection, and (d) thermal recovery (which includes, for example, cyclic steam and steam flooding). In some embodiments, the EOR operation can include a polymer (P) flooding operation, an alkaline-polymer (AP) flooding operation, a surfactant-polymer (SP) flooding operation, an alkaline-surfactant-polymer (ASP) flooding operation, a conformance control operation, or any combination thereof. The terms "operation" and "application" may be used interchangeability herein, as in EOR operations or EOR applications.

The hydrocarbons may be recovered from the formation using radio frequency (RF) heating. For example, at least one radio frequency antenna may be utilized to increase the temperature of the oil and reduce the oil's viscosity. The oil can then be produced from the formation with an improved oil flow rate. Radio frequency may also be used in combination with at least one other recovery technique, such as steam flooding, as described in U.S. Pat. No. 9,284,826, which is incorporated by reference in its entirety. This disclosure utilizes radio frequency for hydrocarbon recovery, and more specifically, this disclosure utilizes dielectric heating (discussed below) for hydrocarbon recovery.

The formation, the hydrocarbons, or both may also include non-hydrocarbon items, such as pore space, connate water, brine, fluids from enhanced oil recovery, etc. The formation may also be divided up into one or more hydrocarbon zones, and hydrocarbons can be produced from each desired hydrocarbon zone.

The term formation may be used synonymously with the term reservoir. For example, in some embodiments, the reservoir may be, but is not limited to, a shale reservoir, a carbonate reservoir, etc. Indeed, the terms "formation," "reservoir," "hydrocarbon," and the like are not limited to any description or configuration described herein.

"Wellbore" refers to a single hole for use in hydrocarbon recovery, including any openhole or uncased portion of the wellbore. For example, a wellbore may be a cylindrical hole drilled into the formation such that the wellbore is surrounded by the formation, including rocks, sands, sediments, etc. A wellbore may be used for dielectric heating. A wellbore may be used for injection. A wellbore may be used for production. In some embodiments, a single dielectric heating wellbore or a single injection wellbore may have at least one corresponding production wellbore, and the hydrocarbons are swept from the single dielectric heating wellbore or the single injection wellbore towards the at least one corresponding production wellbore and then up towards the surface. A wellbore may be used for hydraulic fracturing. A wellbore even may be used for multiple purposes, such as injection and production.

The wellbore may include a casing, a liner, a tubing string, a heating element, a wellhead, a sensor, etc. The "casing" refers to a steel pipe cemented in place during the wellbore construction process to stabilize the wellbore. The "liner" refers to any string of casing in which the top does not extend to the surface but instead is suspended from inside the previous casing. The "tubing string" or simply "tubing" is made up of a plurality of tubulars (e.g., tubing, tubing joints, pup joints, etc.) connected together and it suitable for being lowered into the casing or the liner for injecting a fluid into the formation, producing a fluid from the formation, or any combination thereof. The casing may be cemented into the wellbore with the cement placed in the annulus between the formation and the outside of the casing. The tubing string and the liner are typically not cemented in the wellbore. The wellbore may include an openhole portion or uncased portion. The wellbore may include any completion hardware that is not discussed separately. The wellbore may have vertical, inclined, horizontal, or combination trajectories. For example, the wellbore may be a vertical wellbore, a horizontal wellbore, a multilateral wellbore, or slanted wellbore.

The term wellbore is not limited to any description or configuration described herein. The term wellbore may be used synonymously with the terms borehole or well.

"Dielectric heating" is one form of hydrocarbon recovery using electromagnetic energy in the radio frequency range. Dielectric heating is the process in which a high-frequency alternating electric field, or radio wave or microwave electromagnetic radiation, heats a dielectric material. Molecular rotation occurs in materials containing polar molecules having an electrical dipole moment, with the consequence that they will align themselves with an electromagnetic field. If the field is oscillating, as it is in an electromagnetic wave or in a rapidly oscillating electric field, these molecules rotate continuously aligning with it. As the field alternates, the molecules reverse direction. Rotating molecules push, pull, and collide with other molecules, distributing the energy to adjacent molecules and atoms in the material. Once distributed, this energy appears as heat. This disclosure utilizes radio frequency for hydrocarbon recovery, and more specifically, this disclosure utilizes dielectric heating for hydrocarbon recovery.

In the frequency range of roughly 100 kHz to 100 MHz, dielectric properties of materials depend on their composition, water content, and more significantly on the frequency and the temperature of the medium. The dielectric heating of a unit volume ($m^3$) is given by equation 1: $P=\pi\nu e_o\varepsilon' \tan\delta E^2$ where P is power in watts per cubic meter;

where $\nu$=frequency in hertz;

where $e_o$=8.854×10-12 F/m free space permittivity;

where $\varepsilon'$ is the dielectric constant;

where tan $\delta$ is the loss tangent; and where E is the electric field (in units of V/m)

Equation 1 is discussed in more detail in Sahni, A., Kumar, M., SPE No. 62550, presented at the 2000 SPE/AAPG Western Regional Meeting held in Long Beach, Calif., 19-23 Jun. 2000, which is incorporated by reference in its entirety.

For dielectric heating, the power absorbed by unit of volume is proportional to the dielectric constant and the loss tangent of the material at a given frequency. Thus, these dielectric properties (e.g., $\varepsilon'$ and tan $\delta$) of equation 1 are the key inputs for predicting the response of solids, liquids, or hydrocarbon-containing samples to radio frequency or microwave heating, and to carry out the antenna and transmission line designs. Of note, the terms "radio frequency heating" and "microwave heating" and the like are synonoymous to dielectric heating.

"Permittivity" (which is a positive value with no units) or "dielectric constant" (also referred to as $\varepsilon'$) is a measure of the resistance that is encountered when an electromagnetic field is formed across a material.

"Loss tangent factor" or simply "loss tangent" (also referred to as tan $\delta$, positive value with no units) quantifies the inherent tendency of a material to dissipate or absorb electromagnetic energy and convert it into heat (i.e., energy loss (heat)/energy stored).

"Low porosity-low dielectric material," as discussed herein, refers to a material that has a dielectric constant ($\varepsilon'$) of less than or equal to 20, as well as a loss tangent (tan $\delta$) of less than or equal to 0.4. Furthermore, the low porosity-low dielectric material has a porosity ($\phi$) of less than or equal to 5%. Various embodiments of the low porosity-low dielectric material are provided herein. The term "low porosity-low dielectric material" is not limited to any description or configuration described herein.

"Low dielectric zone," as discussed herein, refers to an area that may be formed in the hydrocarbon-bearing formation with the low porosity-low dielectric material. As will be described further herein, the low porosity-low dielectric material may be provided into a cavity in the hydrocarbon-bearing formation to form the low dielectric zone. Alternatively, as discussed further herein, the low porosity-low dielectric material may be squeezed into the hydrocarbon-bearing formation to form the low dielectric zone. The low dielectric zone is proximate to a radio frequency antenna destination portion of the wellbore for receiving a radio frequency antenna. The term "low dielectric zone" is not limited to any description or configuration described herein.

As used in this specification and the following claims, the term "proximate" is defined as "near". If item A is proximate to item B, then item A is near item B. For example, in some embodiments, item A may be in contact with item B. For example, in some embodiments, there may be at least one barrier between item A and item B such that item A and item B are near each other, but not in contact with each other. The barrier may be a fluid barrier, a non-fluid barrier (e.g., a structural barrier), or any combination thereof.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of +10 percent of the given numeric value provided such a deviation does not alter the end function or result of the value. Therefore, a value of about 1% can be construed to be a range from 0.9% to 1.1%.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

Unless defined otherwise, all technical and scientific terms used herein have the same meanings as commonly understood by one of skill in the art to which the disclosed invention belongs.

Process Overview—

Various embodiments of recovering hydrocarbons from a hydrocarbon-bearing formation using a radio frequency antenna are provided. For example, some embodiments include making a low dielectric zone filled with a low porosity-low dielectric material (e.g., by a cavity based process or a squeezing based process). The radio frequency antenna is positioned in a radio frequency antenna destination portion of the wellbore (e.g., located in a horizontal portion or a vertical portion of the wellbore) that is proximate to the low dielectric zone. The radio frequency antenna is used to heat the hydrocarbons in the hydrocarbon-bearing formation and the low dielectric zone increases dissipation of energy from the radio frequency antenna into the hydrocarbon-bearing formation.

This process reduces the amount of energy that is "dumped" or absorbed near the wellbore. For example, the low porosity-low dielectric material has low to zero porosity to reduce (and even prevent) water invasion from the hydrocarbon-bearing formation and reduce (and even prevent) higher dielectric properties, thus, reducing excessive heat near the wellbore. As previously discussed, excessive heat may damage the radio frequency antenna, the wellbore (e.g., the casing of the wellbore), or any combination thereof. First, the reduced heat near the wellbore improves the likelihood that the radio frequency antenna and the wellbore (and any components of the wellbore such as casing) will operate safely and reliably without any damage. Second, hydrocarbon recovery may also increase because hydrocarbons farther away from the wellbore (that would otherwise not be heated) may now be heated because the low dielectric zone dissipates the energy from the radio frequency antenna farther into the hydrocarbon-bearing formation. For example, hydrocarbon recovery may increase by at least 10% in some embodiments, or may increase in a range of 10% to 40% in some embodiments, by using embodiments consistent with the instant disclosure. Third, the reduced heat near the wellbore may improve efficiency and operation of the overall system, so that less energy is used to achieve the heating of the hydrocarbon-bearing formation with the concomitant economic benefits. In short, a part of the hydrocarbon-bearing formation that is proximate to the radio frequency antenna will be turned into a low dielectric zone, which may in turn reduce excessive heat near the wellbore, dissipate energy from the radio frequency antenna farther into the hydrocarbon-bearing formation, and increase hydrocarbon recovery of the hydrocarbons that are farther into the hydrocarbon-bearing formation.

Low Porosity-Low Dielectric Material—

The low porosity-low dielectric material refers to a material that has a dielectric constant ($\varepsilon'$) of less than or equal to 20 in some embodiments. The low porosity-low dielectric material refers to a material that has a dielectric constant of less than or equal to 15 in some embodiments. The low porosity-low dielectric material refers to a material that has a dielectric constant of less than or equal to 10 in some embodiments. The low porosity-low dielectric material refers to a material that has a dielectric constant of less than or equal to 5 in some embodiments. The low porosity-low dielectric material refers to a material that has a dielectric constant of at least one in some embodiments. The low porosity-low dielectric material refers to a material that has a dielectric constant in a range of 1 to 20 in some embodiments. For comparison, water has a dielectric constant of 80. Depending on the salinity, brines have dielectric constants in a range of 100-1000. The dielectric constant may be determined using a LCR meter. An "LCR meter" is a type of electronic test equipment used to measure inductance (L), capacitance (C), and resistance (R) of an electronic component. The dielectric constant measurements are carried out following ASTM D 150 "Standard Test Methods for AC Loss Characteristics and Permittivity (Dielectric Constant) of Solid Electrical Insulation," which is incorporated by reference in its entirety.

Furthermore, the low porosity-low dielectric material has a loss tangent (tan δ) of less than or equal to 0.4 in some embodiments. The low porosity-low dielectric material has a loss tangent of less than or equal to 0.3 in some embodiments. The low porosity-low dielectric material has a loss tangent of less than or equal to 0.2 in some embodiments. The low porosity-low dielectric material has a loss tangent of less than or equal to 0.1 in some embodiments. The low porosity-low dielectric material has a loss tangent of at least 0.00001 in some embodiments. The low porosity-low dielectric material has a loss tangent in a range of 0.00001 to 0.4 in some embodiments. For comparison, the average loss tangents of water and brines are in a range of 0.4-0.9. The loss tangent may be determined using the LCR meter. The loss tangent measurements are carried out following ASTM D 150 "Standard Test Methods for AC Loss Characteristics and Permittivity (Dielectric Constant) of Solid Electrical Insulation," which is incorporated by reference in its entirety.

Porosity is the percentage of pore volume or void space, or that volume within rock that can contain fluids and not occupied by the solid material. Furthermore, the low porosity-low dielectric material has a porosity (ϕ) of less than or equal to 5% in some embodiments. The low porosity-low dielectric material has a porosity of less than or equal to 4% in some embodiments. The low porosity-low dielectric material has a porosity of less than or equal to 3% in some embodiments. The low porosity-low dielectric material has a porosity of less than or equal to 2% in some embodiments. The low porosity-low dielectric material has a porosity of less than or equal to 1% in some embodiments. The low porosity-low dielectric material has a porosity of zero in some embodiments. The low porosity-low dielectric material has a porosity in a range of 0% to 5% in some embodiments. Porosity may be determined using by several well-known methods such as density measurements, gamma ray measurements, neutron measurements, and nuclear magnetic resonance measurements. Porosity may be measured as described in Smithson, T., Oilfield Review, Autumn 2012: 24, no. 3, 63, which is incorporated by reference in its entirety.

The low porosity-low dielectric material has low to zero porosity to reduce (and even prevent) water invasion from the hydrocarbon-bearing formation and reduce (and even prevent) higher dielectric properties. For example, the porosity of less than or equal to 5% is meant to prevent water invasion during a dielectric heating operation that can last from months to years. Indeed, the use of sand or other similar porous solids alone as low radio frequency absorbance material may not work properly because of their tendency to become water-wet during the days and months of dielectric heating. An increase of water saturation in a mineral formation will lead to an increase in the radio frequency absorption properties, thus, excessive heat near the wellbore.

In a first embodiment, the low porosity-low dielectric material includes a mixture of a granulated solid and a binder. For example, the low porosity-low dielectric material may include a granulated solid mixed with a binder such that the desired dielectric properties (ε', Tan δ) and desired physical properties (ϕ) are achieved. To increase efficiency, the granulated solid may be uniformly dispersed in the binder. The granulated solid may be mixed with the binder using high shear mixer equipment. However, the type of mixing is not important if the solid is uniformly dispersed. The weight ratio of granulated solid to binder ranges from 1:1 to 1:40. The relative amounts of the granulated solid and the binder may be chosen such that the density of the low porosity-low dielectric material is greater than or equal to 4 pounds per gallon (ppg), depending on the depth of the wellbore. In some embodiments, the relative amounts of the granulated solid and the binder may be chosen such that the density of the low porosity-low dielectric material is in a range of 4 pounds per gallon and 18 pounds per gallon. In some embodiments, the combination of the granulated solid and the binder forms a cement.

The granulated solid may include a plurality of particles, such as spherical particles, non-spherical particles, or any combination thereof. In some embodiments, the diameter of the spherical particles is less than or equal to 1 cm. In some embodiments, the diameter of the spherical particles is less than or equal to 0.5 cm. In some embodiments, the particle size of non-spherical particles is less than or equal to 1 cm. In some embodiments, the particle size of non-spherical particles is less than or equal to 0.5 cm. The 1 cm cutoff in diameter or particle size, for example, should facilitate easy pumping of the granulated solid down the wellbore (e.g., via a tubing string). Examples of the granulated solid include, but are not limited to: (a) sand particles (e.g., commercially available Ottawa sand particles such as from Fisher Scientific Cat. No. S23-3), (b) silicon dioxide containing sand particles (e.g., commercially available silicon dioxide containing sand particles such as Fisher Scientific Cat. No. S811-1), (c) ceramic particles (e.g., commercially available ceramic particles such as from Corpuscular Inc., 3590 Route 9, Suite 107, Cold Spring, N.Y. 10516, USA, Cat. No. 412011-20), (d) tar particles (e.g., made by a conventional prilling process into solid pellets), (e) Solvent Deasphalted (SDA) tar particles (e.g., made by a conventional prilling process into solid pellets), (f) glass particles (e.g., commercially available glass spheres such as Thermo Scientific Cat. No. 09-980-083), (g) nitrogen-filled glass particles (e.g., commercially available nitrogen-filled glass spheres such as 3M™ Glass Bubbles A16/500), (h) Teflon™ particles (e.g., commercially available Teflon™ particles such as Dupont™ Teflon™ particles), (i) polyetheretherketone (PEEK) particles (e.g., commercially available PEEK particles such as VICTREX™ particles), (j) polydicyclopentadiene (pDCPD) resin (e.g., commercially available as Telene™ 1650 from Telene S.A.S, Drocourt, France), or (k) any combination thereof (e.g., any combination of (a), (b), (c), (d), (e), (f), (g), (h), (i), and/or (j)). Those of ordinary skill in the art will appreciate that practically any combination of particles, diameters, and particle sizes may be envisioned for the granulated solid.

Prilling refers to a process for pelletizing a solid material by melting the material and spraying the molten material, whereby droplets of the material solidify. Of note, prilling involves the atomization of an essentially solvent free, molten purified feed material in countercurrent flow with a cooling gas to cool and solidify the purified feed material. Typically, prilling is conducted at near ambient temperature.

The binder may be a fluid, for example, as it is pumped down the wellbore. The binder may set to a solid, while in the hydrocarbon-bearing formation. The initial viscosity of the binder may be in a range of 1 cP to 4,000 cP. Examples of the binder include, but are not limited to: (a) a cement slurry (e.g., the cement slurry is composed of Portland cement (e.g., a Portland cement blend containing silica such as the commercially available silica from Fisher Scientific Cat. No. S818-1) and water). (b) an oxygen containing low dielectric material (e.g., has a dielectric constant of less than or equal to 20, a loss tangent of less than or equal to 0.4, and a porosity of less than or equal to 5%), (c) a hydrocarbon polymer, (d) a derivatized hydrocarbon polymer, (e) a hydrocarbon monomer, or (f) any combination thereof (e.g., any combination of (a), (b), (c), (d), and/or (e)). Examples of the oxygen containing low dielectric material include, but are not limited to: furfuryl alcohol, polyfuryl alcohol, epoxy, aromatic amine crossed linked epoxy, diglycidyl ether of bisphenol A, diglycidyl ether of bisphenol F, or any combination thereof. Examples of the hydrocarbon polymer include, but are not limited to: polydiene, polyisoprene, polybutadiene, polyisobutylene, polybutene, co-polymers of polyisoprene and polybutylene, polynorbomene, cis-polynorbomene, EPDM rubber, or any combination thereof. Examples of the derivatized hydrocarbon polymer include, but are not limited to: epoxidized EPDM rubber, epoxidized polyisoprene, epoxidized polyisobutylene, epoxidized natural rubber, silicone modified EDPM rubber, silicone modified polyisobutylene, silicone modified polyisoprene, silicone modified natural rubber, or any combination thereof. Examples of the hydrocarbon monomer include, but are not limited to: isobutylene, 1-butene, isoprene, norbomene, dicyclopentadiene, or any combination thereof.

To harden the binder in the hydrocarbon-bearing formation, one or more catalysts may be added to the binder. Examples of the catalyst include, but are not limited to: (a) an acid to polymerize furfuryl alcohol to polyfurfuryl alcohol, (b) a water resistant ring opening metathesis polymerization catalyst to polymerize norbomene to polynorbomene, (c) a water resistant ring opening metathesis polymerization catalyst to polymerize dicyclopentadiene to polydicyclopentadiene, (d) a peroxide based curing agent used to cross-link diene, (e) isoprene, (f) butadiene, (g) butylene, (h) isobutylene, (i) polyisoprene, (j) polybutadiene, (k) polyisobutylene, (l) polybutene, (m) co-polymers of polyisoprene and polybutylene, (n) polynorbomene, (o) cis-polynorbomene, (p) EPDM rubber, (q) a derivatized hydrocarbon polymer, or (r) any combination thereof (e.g., any combination of (a), (b), (c), (d), (e), (f), (g), (h), (i), (j), (k), (l), (m), (n), (o), (p), and/or (q)). Examples of the derivatized hydrocarbon polymer include, but are not limited to: epoxidized EPDM rubber, epoxidized polyisoprene, epoxidized polyisobutylene, epoxidized natural rubber, silicone modified EDPM rubber, silicone modified polyisobutylene, silicone modified polyisoprene, silicone modified natural rubber, or any combination thereof.

In yet another embodiment, the granulated solid discussed in the context of the first embodiment (without the binder) may be an embodiment of the low porosity-low dielectric material. For example, the granulated solid (without the binder) may be easier to use in the cavity based process.

In yet another embodiment, the binder discussed in the context of the first embodiment (without the granulated solid) may be an embodiment of the low porosity-low dielectric material. In this other embodiment, the binder (without the granulated solid) may include or not include a catalyst as discussed in the context of the first embodiment. For example, the binder (without the granulated solid) may be used in both the cavity based process and the squeezing based process.

In a second embodiment, the low porosity-low dielectric material includes a cement slurry. In one embodiment, the cement slurry is composed of Portland cement (e.g., a Portland cement blend containing silica such as the commercially available silica from Fisher Scientific Cat. No. S818-1) and water. Furthermore, the cement slurry includes an additive. Examples of the additive include, but are not limited to: (a) a hydrocarbon (e.g., asphaltite), (b) a fluid loss control additive (e.g., to provide a density greater than or equal to 4 pounds per gallon (ppg), (c) a defoamer, (d) a dispersant, (e) a thixotropic agent (e.g., commercially available gypsum), (f) pozzolanic based hollow microspheres, or (g) any combination thereof (e.g., any combination of (a), (b), (c), (d), (e), and/or (f)). Of note, a non-Portland cement blend may be utilized in some embodiments. Examples of the fluid loss control additive include, but are not limited to: polyacriamide, polyethyleneamines, carboxymethylhydroxyethylcellulose, hydroxyethylcellulose, a commercially available fluid loss control additive such as bentonite, or any combination thereof. Examples of the defoamer include, but are not limited to: lauryl alcohol, poly(propylene glycol), a commercially available defoamer such as alkylarylsulfonate, or any combination thereof. Examples of the dispersant include, but are not limited to: succinimides, succinates esters, alkylphenol amides, a commercially available dispersant such as nonylphenol Aldrich Cat. No. 290858, or any combination thereof. Examples of the pozzolanic based hollow microspheres include, but are not limited to: perlite, expanded perlite, scoria, pumice, a commercially available pozzolanic based hollow microspheres such as 3M™ Glass Bubbles A16/500, or any combination thereof. The relative amounts of the components of the cement slurry may be chosen such that the density of the low porosity-low dielectric material is greater than or equal to 4 pounds per gallon. In some embodiments, the relative amounts of the components of the cement slurry may be chosen such that the density of the low porosity-low dielectric material is in a range of 4 pounds per gallon and 18 pounds per gallon.

In a third embodiment, the low porosity-low dielectric material includes a foamed cement mixture. For example, the foamed cement mixture is an admixture of a cement slurry, a foaming agent, and nitrogen. In one embodiment, the cement slurry is composed of Portland cement (e.g., a Portland cement blend containing silica such as the commercially available silica from Fisher Scientific Cat. No. S818-1) and water. Examples of the foaming agent include, but are not limited to: (a) copolymers of acrylamide and acrylic acid, (b) terpolymers of acrylamide-acrylic acid, (c) polyglutamates, (d) sodium polystyrene-sulfonates, (e) potassium polystyrene-sulfonates, (f) copolymers of methacrylamide and acrylic acid, (g) copolymers of acrylamide and methacrylic acid, (h) copolymers of methacrylamide and methacrylic acid, (i) a polymer, or (j) any combination thereof (e.g., any combination of (a), (b), (c), (d), (e), (f), (g), (h), and/or (i)). Examples of the polymer include, but are not limited to: acrylamide, acrylic acid, methacrylamide, methacrylic acid, or any combination thereof. The nitrogen may be compressed nitrogen gas, boil off from a liquid nitrogen tank, or any other nitrogen source. The relative amounts of the cement slurry, the foaming agent, and the nitrogen may be chosen such that the density of the low porosity-low dielectric material is greater than or equal to 4 pounds per gallon. In some embodiments, the relative amounts of the cement slurry, the foaming agent, and the nitrogen may be chosen such that the density of the low porosity-low dielectric material is in a range of 4 pounds per gallon and 18 pounds per gallon.

In a fourth embodiment, the low porosity-low dielectric material includes a foamed cement mixture having a low dielectric weighing agent. For example, the foamed cement mixture is an admixture of a cement slurry, a foaming agent, and nitrogen as described in the third embodiment hereinabove. The low dielectric weighing agent may be utilized to achieve a density target. The low dielectric weighting agent has a dielectric constant of less than or equal to 20, as well as a loss tangent of less than or equal to 0.4 and a porosity of less than or equal to 5%. Examples of the low dielectric weighting agent include, but are not limited to: (a) mica particles (e.g., commercially available mica particles such as Mica powder from AXIM MICA, 105 North Gold Drive, Robbinsville, N.J. 08691), (b) ground Teflon™ particles (e.g., commercially available Teflon particles such as Dupont™ Teflon™ particles), (c) quartz sand particles (e.g., commercially available quartz sand particles such as Honeywell-Fluka Cat. No. 60-022-46), or (d) any combination thereof (e.g., any combination of (a), (b), and/or (c)). The relative amounts of the cement slurry, the foaming agent, the nitrogen, and the weighting agent may be chosen such that the density target of the low porosity-low dielectric material is greater than or equal to 4 pounds per gallon. In some embodiments, the relative amounts of the cement slurry, the foaming agent, the nitrogen, and the weighting agent may be chosen such that the density target of the low porosity-low dielectric material is in a range of 4 pounds per gallon and 18 pounds per gallon.

In a fifth embodiment, the low porosity-low dielectric material includes a mixture of a cement slurry and a hydrocarbon containing material. The cement slurry is composed of Portland cement (e.g., a Portland cement blend containing silica such as the commercially available silica from Fisher Scientific Cat. No. S818-1) and water. One example of the hydrocarbon containing material may be solvent deasphalted (SDA) tar particles (made by a conventional prilling process into solid pellets). SDA tar is also called SDA residue or SDA pitch. The SDA tar may have significantly low dielectric properties (e.g., $\varepsilon'<3$ and Tan $\delta<0.1$) to provide the desired RF compatible characteristics. Other hydrocarbon containing material include, but are not limited to: (a) heavy crude oil, (b) vacuum residue (e.g., commercially available vacuum residue such as made by a conventional prilling process into solid pellets), (c) atmospheric residue (e.g., commercially available atmospheric residue such as made by a conventional prilling process into solid pellets), (d) an asphaltene fraction (e.g., commercially available asphaltene fraction such as made by a conventional prilling process into solid pellets), (e) a natural occurring mineral (e.g., asphaltite, solid bitumen, or other similar materials), or (f) any combination thereof (e.g., any combination of (a), (b), (c), (d), and/or (e)).

Due to the use of the hydrocarbon containing material in the mixture of this fifth embodiment, a cement-setting accelerant may also be utilized. Examples of the cement-setting accelerant include, but are not limited to: (a) calcium chloride, (b) sodium chloride, (c) gypsum, (d) sodium silicate, or (e) any combination thereof (e.g., any combination of (a), (b), (c), and/or (d)). The relative amounts of the cement slurry, the hydrocarbon containing material, and the cement-setting accelerant may be chosen such that the density of the low porosity-low dielectric material greater than or equal to 4 pounds per gallon. In some embodiments, the relative amounts of the cement slurry, the hydrocarbon containing material, and the cement-setting accelerant may be chosen such that the density of the low porosity-low dielectric material is in a range of 4 pounds per gallon and 18 pounds per gallon. The setting time may be less than or equal to 2 days.

Those of ordinary skill in the art will appreciate that various embodiments of the low porosity-low dielectric material have been provided herein, but the embodiments provided herein are not meant to limit the scope of the disclosure. Furthermore, those of ordinary skill in the art will appreciate that various modifications may be made to the embodiments provided herein, and that alternative embodiments of the low porosity-low dielectric material may be utilized. For example, an alternative embodiment of the low porosity-low dielectric material may include a plurality of low porosity-low dielectric materials (e.g., two low porosity-low dielectric materials are utilized).

Although many modification may be made, those of ordinary skill will appreciate that thermal stability of the components used in the low porosity-low dielectric material is important. The low porosity-low dielectric material should be stable at a high temperature (e.g., equal to or greater than 300° F. in some embodiments, equal to or greater than 400° F. in some embodiments, in a range of 200° F. to 500° F. in some embodiments, or in a range of 300° F. to 450° F. in some embodiments) and should not degrade while in the presence of formation fluids for an extended time period (e.g., ranging from 1 month to 5 years). Furthermore, it is important that the desirable low porosity and low dielectric properties of the low porosity-low dielectric material be maintained throughout the time period, even when the low porosity-low dielectric material is subject to high temperatures, when the RF antenna is running.

Cavity Based Process—

The low porosity-low dielectric material may be utilized to make a low dielectric zone via a cavity based process. For example, the wellbore may be initially drilled into the hydrocarbon-bearing formation and the wellbore includes the radio frequency antenna destination portion that is configured to receive the radio frequency antenna. The radio frequency antenna destination portion may be in a horizontal portion of the wellbore in some embodiments, but the radio frequency antenna destination portion may be in a vertical portion of the wellbore in other embodiments. In some embodiments, the inner diameter of the wellbore is less than or equal to 15 inches.

The wellbore may be subsequently underreamed to enlarge the wellbore past its originally drilled size to form the cavity. In some embodiments, the cavity has an inner diameter that is less than or equal to 50 inches. The low porosity-low dielectric material is provided into the cavity to form the low dielectric zone in the hydrocarbon-bearing formation. In some embodiments, the low porosity-low dielectric material may be provided into the cavity by providing a tubing string in the wellbore and using the tubing string to deliver the low porosity-low dielectric material into the cavity.

The radio frequency antenna is positioned into the radio frequency antenna destination portion (e.g., which may include casing such as low loss casing or without casing) of the wellbore such that the radio frequency antenna is proximate to the low dielectric zone to heat the hydrocarbon-bearing formation. In some embodiments, the radio frequency antenna has a power density in a range of 1 kW to 12 kW per meter of antenna. The low dielectric zone increases dissipation of energy from the radio frequency antenna into the hydrocarbon-bearing formation. The hydrocarbons are extracted from the heated hydrocarbon-bearing formation.

FIG. 1 illustrates one embodiment of a method of recovering hydrocarbons from a hydrocarbon-bearing formation using a radio frequency antenna referred to as a method 100. Reference will be made to the embodiments illustrated in FIGS. 2A-2D and FIGS. 3A-3E, as appropriate, to facilitate understanding of the method 100.

Figure 2D:
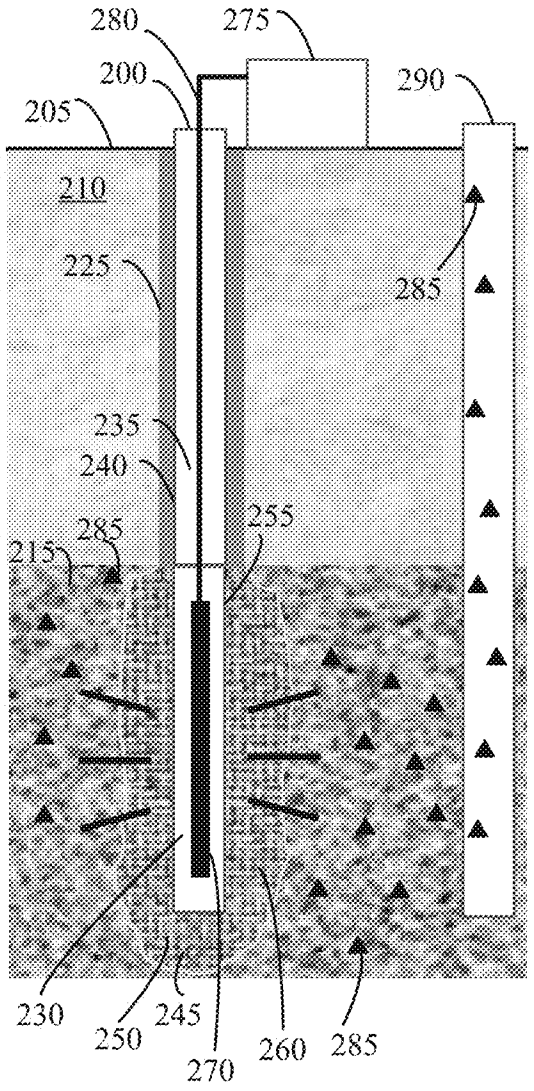
FIG. 2D illustrates, in cross-section, one embodiment of a low dielectric zone formed with the low-porosity-low dielectric material of FIG. 2C and one embodiment of a radio frequency antenna in the low dielectric zone.
Figure 2C:
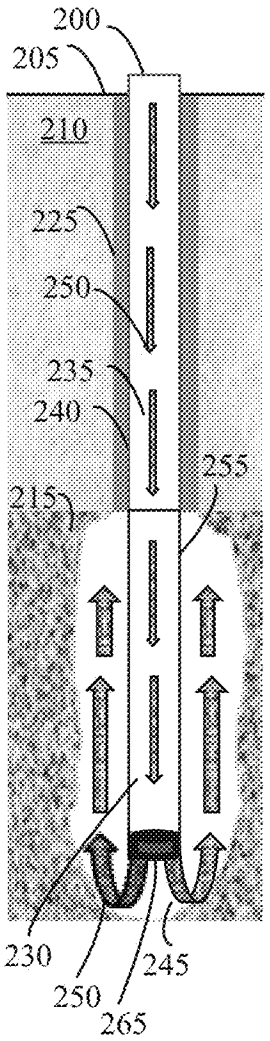
FIG. 2C illustrates, in cross-section, one embodiment of a low porosity-low dielectric material pumped into the cavity of FIG. 2B.
Figure 2B:
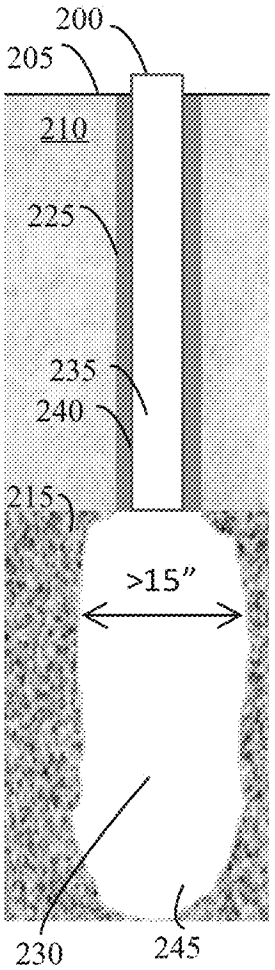
FIG. 2B illustrates, in cross-section, one embodiment of a cavity in a pay zone proximate to a radio frequency antenna destination portion of the wellbore of FIG. 2A.
Figure 2A:
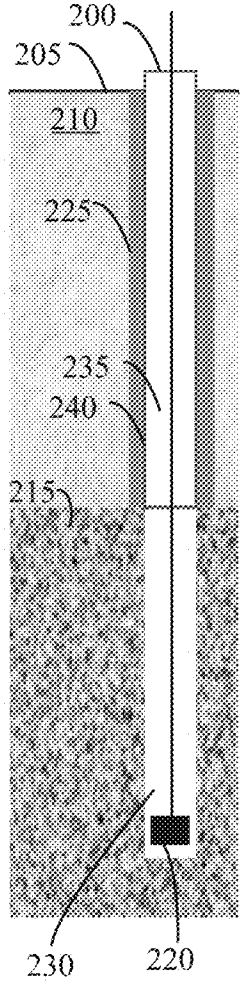
FIG. 2A illustrates, in cross-section, one embodiment of a wellbore that may be drilled per the cavity based process described in FIG. 1.

At 105, the method 100 includes drilling a wellbore in a hydrocarbon-bearing formation. The wellbore includes a radio frequency antenna destination portion (e.g., in a horizontal portion or vertical portion of the wellbore) that is configured to receive a radio frequency antenna. The wellbore may have an inner diameter that is less than or equal to 15 inches. For example, as illustrated in FIG. 2A, a wellbore 200 may be drilled through a surface 205, through an overburden 210, and into a pay zone 215. The pay zone 215 includes hydrocarbons. The wellbore 200 is drilled using a drill bit 220 and other equipment known to those of ordinary skill in the art. The wellbore 200 is cemented in place via cement 225.

The wellbore 200 includes a radio frequency antenna destination portion 230 for receiving the radio frequency antenna, and the rest of the wellbore 200 will be referred to as remainder portion 235 for simplicity. The remainder portion 235 may include casing 240, such that an outer cement layer (i.e., the cement 225) surrounds an inner casing layer (i.e., the casing 240). An interior space is provided inside the casing 240 to permit passage of fluid such as the low porosity-low dielectric material, equipment such as the radio frequency antenna, etc. The wellbore 200 may have an inner diameter that is less than or equal to 15 inches throughout the length of the wellbore 200, including throughout the length of the radio frequency antenna destination portion 230 and the remainder portion 235.

At 110, the method 100 includes creating a cavity in the hydrocarbon-bearing formation proximate to the radio frequency antenna destination portion of the wellbore. In some embodiments, the cavity is created in the hydrocarbon-bearing formation by enlarging the wellbore past its originally drilled size. In some embodiments, the cavity has an inner diameter that is less than or equal to 50 inches. For example, as illustrated in FIG. 2B, a cavity 245 was created in the pay zone 215 proximate to the radio frequency antenna destination portion 230 by enlarging the wellbore 200 past its originally drilled size. The original diameter of the wellbore 200 was less than or equal to 15 inches in the radio frequency antenna destination portion 230, however, the cavity 245 has an inner diameter that is much larger, such as, an inner diameter between 16 inches and 50 inches. The wellbore 200 was enlarged past its originally drilled size via underreaming, as well as equipment utilized for underreaming.

At 115, the method 100 includes providing a low porosity-low dielectric material into the cavity to form a low dielectric zone in the hydrocarbon-bearing formation proximate to the radio frequency antenna destination portion. For example, as illustrated in FIGS. 2C-2D, a low porosity-low dielectric material 250 may be pumped through the corresponding casing 240 of the remainder portion 235, through a corresponding casing 255 of the radio frequency antenna destination portion 230, and out of the wellbore 200 into the cavity 245 to form a low dielectric zone 260 in the pay zone 215 proximate to the radio frequency antenna destination portion 230. Although not illustrated, the low porosity-low dielectric material 250 may be stored at a location on the surface 205, such as in at least one tank on the surface 205, and it may be pumped from the surface 205 into the wellbore 200 and into the cavity 245 using at least one pump.

Like the casing 240, the casing 255 also includes an interior space for passage of equipment, fluid, etc. The casing 255 may be coupled to the casing 240 of the remainder portion 235 and terminate at a float shoe 265. In some embodiments, the casing 255 may be a low loss casing, such as a casing made of fiberglass or a casing made of a radio frequency transparent material. Commercially available examples of the casing 255 may include the Star™ Aromatic Amine filament-wound fiberglass/epoxy casing from NOV Fiber Glass Systems, 17115 San Pedro Ave., Suite 200, San Antonio, Tex. 78232, USA. The low loss casing may have a dielectric constant of less than or equal to 20 in some embodiments. The low loss casing may have a dielectric constant of less than or equal to 10 in some embodiments. The low loss casing may have a loss tangent of less than or equal to 0.4 in some embodiments. The low loss casing may have a loss tangent of less than or equal to 0.3 in some embodiments. The casing 255 may be installed after the cavity 245 is created using methods and equipment known to those of ordinary skill in the art.

At 120, the method 100 includes positioning the radio frequency antenna into the radio frequency antenna destination portion such that the radio frequency antenna is proximate to the low dielectric zone in the hydrocarbon-bearing formation. For example, as illustrated in FIG. 2D, a radio frequency (RF) antenna 270 may be positioned, via a rig (not shown) at the surface 205, into the radio frequency antenna destination portion 230 such that the radio frequency antenna 270 is surrounded by the casing 255 of the radio frequency antenna destination portion 230. By doing so, the radio frequency antenna 270 is also positioned proximate to the low dielectric zone 260 in the pay zone 215.

The radio frequency antenna 270 converts electric energy into electromagnetic energy, which is radiated in part from the radio frequency antenna 270 in the form of electromagnetic waves and in part forms a reactive electromagnetic field near the radio frequency antenna 270. U.S. Pat. Nos. 9,598,945, 9,284,826, and U.S. Patent Application Publication No. 2014/0266951, each of which is incorporated by reference in its entirety, include various embodiments of radio frequency antennas and systems that may be utilized herein. Those of ordinary skill in the art will appreciate that other radio frequency antennas may also be utilized herein.

The radio frequency antenna 270 may be coupled to a radio frequency generator 275, for example, at the surface 205, by at least one transmission line 280. The radio frequency generator 275 operates to generate radio frequency electric signals that are delivered to the radio frequency antenna 270. The radio frequency generator 275 is arranged at the surface in the vicinity of the wellbore 200. In some embodiments, the radio frequency generator 275 includes electronic components, such as a power supply, an electronic oscillator, frequency tuning circuitry, a power amplifier, and an impedance matching circuit. In some embodiments, the radio frequency generator 275 includes a circuit that measures properties of the generated signal and attached loads, such as for example: power, frequency, as well as the reflection coefficient from the load.

In some embodiments, the radio frequency generator 275 is operable to generate electric signals having a frequency inversely proportional to a length L1 of the radio frequency antenna 270 to generate standing waves. For example, when the radio frequency antenna 270 is a half-wave dipole antenna, the frequency is selected such that the wavelength of the electric signal is roughly twice the length L1. In some embodiments, the radio frequency generator 275 generates an alternating current (AC) electric signal having a sine wave.

In some embodiments, the frequency or frequencies of the electric signal generated by the radio frequency generator 275 is in a range from about 5 kHz to about 20 MHz, or in a range from about 50 kHz to about 2 MHz. In some embodiments, the frequency is fixed at a single frequency. In another possible embodiment, multiple frequencies can be used at the same time.

In some embodiments, the radio frequency generator 275 generates an electric signal having a power in a range from about 50 kilowatts to about 2 megawatts. In some embodiments, the power is selected to provide minimum amount of power per unit length of the radio frequency antenna 270. In some embodiments, the minimum amount of power per unit length of the radio frequency antenna 270 is in a range from about 0.5 kW/m to 5 kW/m. Other embodiments generate more or less power. In some embodiments, the radio frequency antenna 270 has a power density in a range of 1 kW to 12 kW per meter of antenna.

The transmission line 280 provides an electrical connection between the radio frequency generator 275 and the radio frequency antenna 270, and delivers the radio frequency signals from the radio frequency generator 275 to the radio frequency antenna 270. In some embodiments, the transmission line 280 is contained within a conduit that supports the radio frequency antenna 270 in the appropriate position within the wellbore 200, and is also used for raising and lowering the radio frequency antenna 270 into place. An example of a conduit is a pipe. One or more insulating materials may be included inside of the conduit to separate the transmission line 280 from the conduit. In some embodiments, the conduit and the transmission line 280 form a coaxial cable. In some embodiments, the conduit is sufficiently strong to support the weight of the radio frequency antenna 270, which can weigh as much as 5,000 pounds to 10,000 pounds in some embodiments.

At 125, the method 100 includes dielectric heating the hydrocarbon-bearing formation with the radio frequency antenna such that the low dielectric zone increases dissipation of energy from the radio frequency antenna into the hydrocarbon-bearing formation. For example, as illustrated in FIG. 2D, the pay zone 215 may be dielectrically heated with the radio frequency antenna 270, and the low dielectric zone 260 increases dissipation of the energy from the radio frequency antenna 270 into the pay zone 215 to heat portions of the pay zone 215 that are farther away from the wellbore 200. Dielectric heating of the pay zone 215 by the radio frequency antenna 270 causes hydrocarbons 285 in the pay zone 215 to also be heated, which reduces the viscosity of the hydrocarbons 285. The hydrocarbons 285 with lower viscosity are easier to extract from the pay zone 215.

In some embodiments, once the radio frequency antenna 270 is properly positioned, the radio frequency generator 275 may begin generating radio frequency signals that are delivered to the radio frequency antenna 270 through the transmission line 280. The radio frequency signals are converted into electromagnetic energy, which is emitted from the radio frequency antenna 270 in the form of electromagnetic waves E. The electromagnetic waves E pass through the wellbore 200, through the low dielectric zone 260, and into the pay zone 215. The electromagnetic waves E cause dielectric heating to occur, primarily due to the molecular oscillation of polar molecules present in the pay zone 215 caused by the corresponding oscillations of the electric fields of the electromagnetic waves E. The dielectric heating may continue until a desired temperature has been achieved at a desired location in the pay zone 215, which reduces the viscosity of the hydrocarbons 285 to enhance flow of the hydrocarbons 285 within the pay zone 215. In some embodiments, the power of the electromagnetic energy delivered is varied during the heating process (or turned on and off) as needed to achieve a desired heating profile.

In some embodiments, the dielectric heating operates to raise the temperature of the pay zone 215 from an initial temperature to at least a desired temperature greater than the initial temperature. In some formations, the initial temperature may range from as low as 40° F. to as high as 240° F. In other formations, the initial temperature is much lower, such as between 40° F. and 80° F. Dielectric heating may be performed until the temperature is raised to the desired minimum temperature to sufficiently reduce the viscosity of the hydrocarbons 285. In some embodiments, the desired minimum temperature is in a range from 160° F. to 200° F., or about 180° F. In some embodiments, the temperature is increased by 40° F. to 80° F., or by about 60° F. Of note, higher temperatures may be achieved particularly in portions of the pay zone 215 proximate to the radio frequency antenna 270. However, the temperatures proximate to the radio frequency antenna 270 should be lower due to the presence of the low dielectric zone 260, as compared to temperatures proximate to the radio frequency antenna 270 without the presence of the low dielectric zone 260.

In some embodiments, the length of time that the dielectric heating is applied is in a range of 1 month to 1 year, or in a range of 4 months to 8 months, or about 6 months, or 1 year to 5 years. Dielectric heating may even be applied for longer than 5 years in some embodiments. Other time periods are used in other embodiments. The time period can be adjusted by adjusting other factors, such as the power of the radio frequency antenna 270, or the size of the pay zone 215.

At 130, the method 100 includes extracting hydrocarbons from the heated hydrocarbon-bearing formation. For example, as illustrated in FIG. 2D, the hydrocarbons 285 of the pay zone 215, which have been dielectrically heated by the radio frequency antenna 270, may be extracted from the pay zone 215 using any technique and equipment (e.g., an artificial lift system such as electric submersible pump, a tubing string, etc.) known to those of ordinary skill in the art. In some embodiments, the hydrocarbons 285 flow towards at least one production wellbore 290, enter the production wellbore 290, and flow up the production wellbore 290 towards the surface 205 for further processing (e.g., separating of other fluids from the hydrocarbons 285, recycling of the other fluids, refining, transporting, etc.). The hydrocarbons 285 may enter the production wellbore 290 through at least one opening (e.g., perforations) in the production wellbore 290. The production wellbore 290 may include a cased portion in some embodiments, an uncased portion in some embodiments, etc. The production wellbore 290 may be completely vertical in some embodiments. The production wellbore 290 may include a horizontal portion in some embodiments. The production wellbore 290 may be coupled to a wellhead, a flow meter, a sensor, or any other appropriate equipment.

In some embodiments, dielectric heating with the radio frequency antenna 270 may be the only form of hydrocarbon recovery utilized to recover the hydrocarbons 285 from the pay zone 215. However, in some embodiments, dielectric heating with the radio frequency antenna 270 and at least one other form of hydrocarbon recovery (e.g., steam flooding) may be utilized to recovery the hydrocarbons 285 from the pay zone 215.

Figures 3A, 3B, 3C, 3D, 3E:
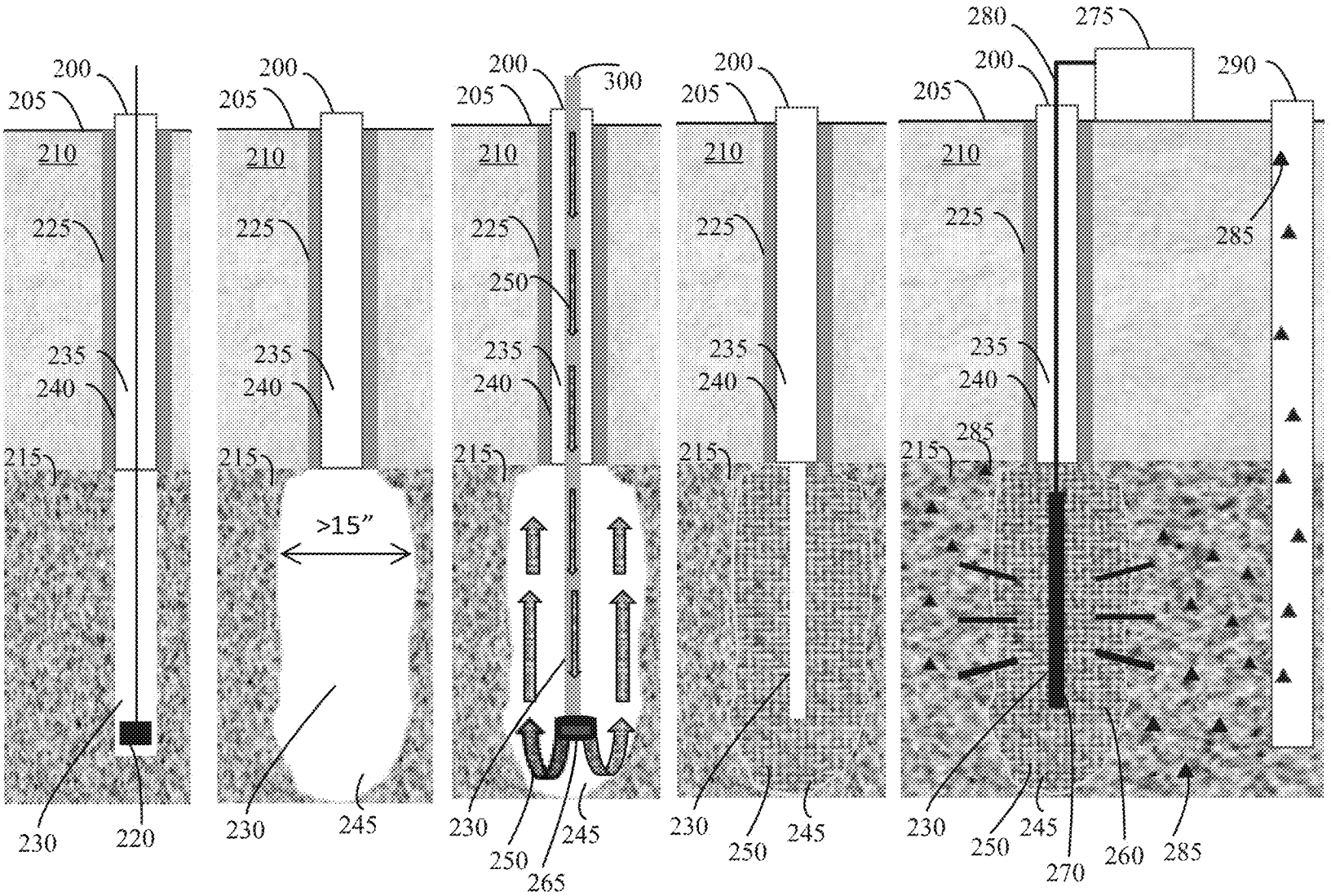
FIG. 3A illustrates, in cross-section, one embodiment of a wellbore that may be drilled per the cavity based process described in FIG. 1.
FIG. 3B illustrates, in cross-section, one embodiment of a cavity in a pay zone proximate to a radio frequency antenna destination portion of the wellbore of FIG. 3A.
FIG. 3C illustrates, in cross-section, one embodiment of a low porosity-low dielectric material pumped via a tubing string into the cavity of FIG. 3B.
FIG. 3D illustrates, in cross-section, one embodiment of removal of the tubing string of FIG. 3C.
FIG. 3E illustrates, in cross-section, one embodiment of a low dielectric zone formed with the low porosity-low dielectric material of FIG. 3C and one embodiment of a radio frequency antenna in the low dielectric zone.

Those of ordinary skill in the art will appreciate that modifications may be made to the cavity based process, and the method 100 is not meant to limit the scope of the claims. For example, FIGS. 3A-3E illustrate some modifications. FIG. 3A is similar to FIG. 2A and FIG. 3B is similar to FIG. 3B, but FIG. 3C illustrates that the radio frequency antenna destination portion 230 of the wellbore 200 may not include the casing 255 in some embodiments. Instead, the low porosity-low dielectric material 250 may be provided into the cavity 245 by first providing a tubing string 300 in the wellbore 200. For example, the tubing string 300 may pass through the casing 240 of the remainder portion 235, through the casing-less radio frequency antenna destination portion 230, and terminates at the float shoe 265. The tubing string 300 is used to deliver the low porosity-low dielectric material 250 into the cavity 245 to form the low dielectric zone 260. After the low dielectric zone 260 has been formed in the cavity 245, FIG. 3D illustrates that the tubing string 300 may be removed from the wellbore 200, and FIG. 3E illustrates that the radio frequency antenna 270 may be positioned in the radio frequency antenna destination portion 230 of the wellbore 200. The radio frequency antenna 270 may then be used for dielectric heating as previously discussed.

Of note, due to the lack of casing 255, the radio frequency antenna destination portion 230 at FIGS. 3D-3E may become narrower than originally drilled. Moreover, due to the lack of casing 255, the low dielectric zone 260 may surround (and even contact) the radio frequency antenna 270, the transmission line 280, or any combination thereof. Also of note, if there is no casing 255 around the radio frequency antenna 270, then the radio frequency antenna 270 should be electrically insulated from the ground, for example, using a polymeric cover, electrically insulated painting, etc. Examples of polymeric containing electrically insulating materials include, but are not limited to: a PEEK film or sheet, a PPS film or sheet, an epoxy, an aromatic amine cross-linked epoxy, an epoxy glass fiber composite, an aromatic amine cross-linked epoxy based composite, or any combination thereof. Furthermore, if there is no casing 255 around the radio frequency antenna 270, then the radio frequency antenna 270 should also be protected from any hydrocarbons, water, fluids, or the like that are present in the formation.

Figure 6A:
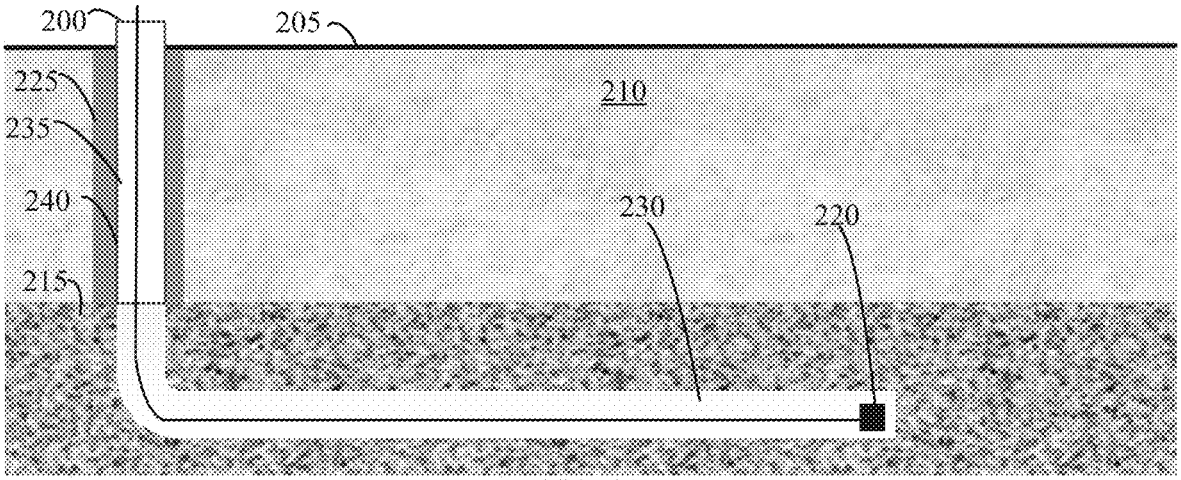
FIG. 6A illustrates, in cross-section, one embodiment of a wellbore, having a horizontal portion, that may be drilled per the squeezing based process described in FIG. 4.
Figure 6B:
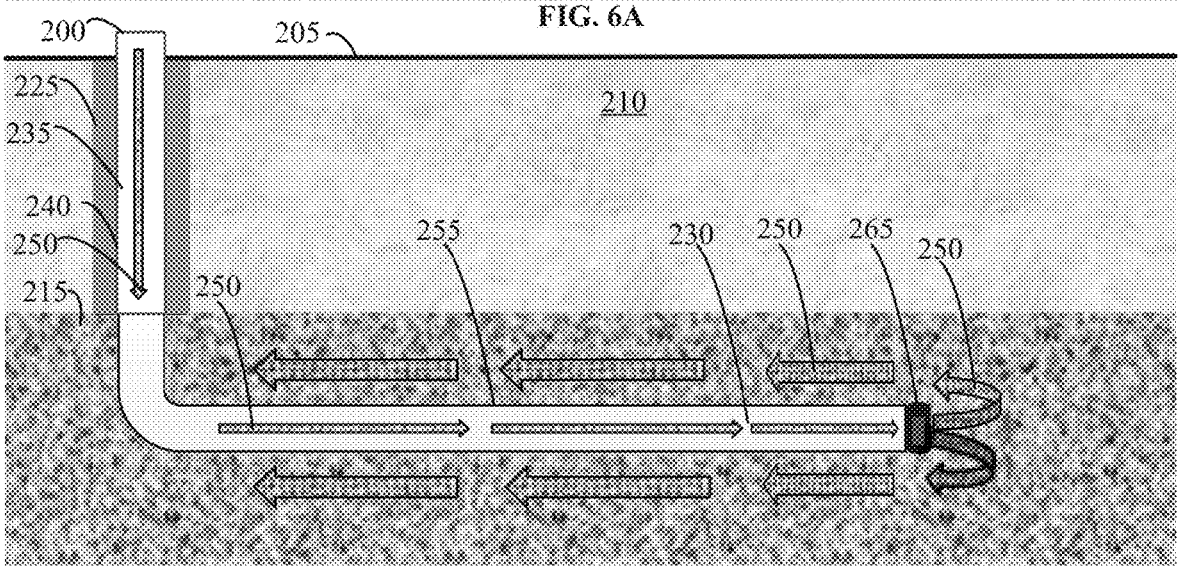
FIG. 6B illustrates, in cross-section, one embodiment of a low porosity-low dielectric material squeezed into a pay zone proximate to a radio frequency antenna destination portion in the horizontal portion of FIG. 6A.
Figure 6C:
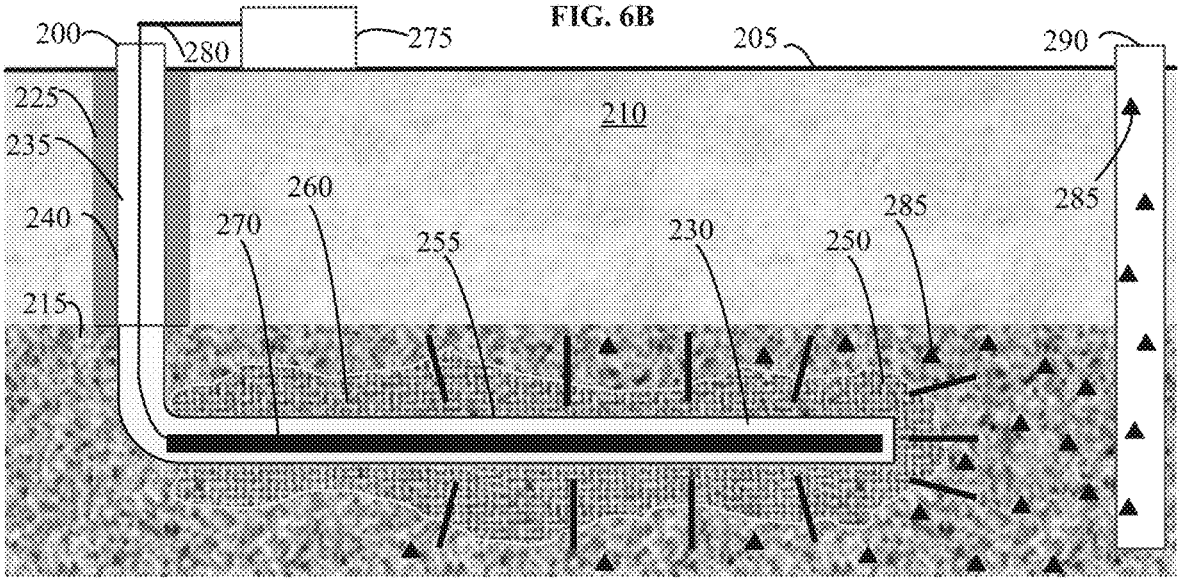
FIG. 6C illustrates, in cross-section, one embodiment of a low dielectric zone formed with the low-porosity-low dielectric material of FIG. 6B and one embodiment of a radio frequency antenna in the low dielectric zone.

As another example modification, the wellbore 200 may have a horizontal trajectory (as illustrated in FIGS. 6A-6C) in some embodiments, and as such, the radio frequency antenna destination portion 230 may be located in a horizontal portion of the wellbore 200. The cavity 245 may be formed by underreaming the radio frequency antenna destination portion 230 in the horizontal portion, and the low dielectric zone 260 may be formed in the cavity 245 as discussed herein.

Squeezing Based Process—

The low porosity-low dielectric material may be utilized to make a low dielectric zone via a squeezing based process. For example, the wellbore may be drilled into the hydrocarbon-bearing formation and the wellbore includes the radio frequency antenna destination portion that is configured to receive the radio frequency antenna. The radio frequency antenna destination portion is in a horizontal portion of the wellbore in some embodiments, but the radio frequency antenna destination portion is in a vertical portion of the wellbore in other embodiments. In some embodiments, the inner diameter of the wellbore is less than or equal to 15 inches.

The low porosity-low dielectric material is squeezed into the hydrocarbon-bearing formation to form the low dielectric zone proximate to the radio frequency antenna destination portion. The radio frequency antenna is positioned into the radio frequency antenna destination portion (e.g., which may include casing such as low loss casing or without casing) of the wellbore such that the radio frequency antenna is proximate to the low dielectric zone to heat the hydrocarbon-bearing formation. In some embodiments, the radio frequency antenna has a power density in a range of 1 kW to 12 kW per meter of antenna. The low dielectric zone increases dissipation of energy from the radio frequency antenna into the hydrocarbon-bearing formation. The hydrocarbons are extracted from the heated hydrocarbon-bearing formation.

Figure 4:
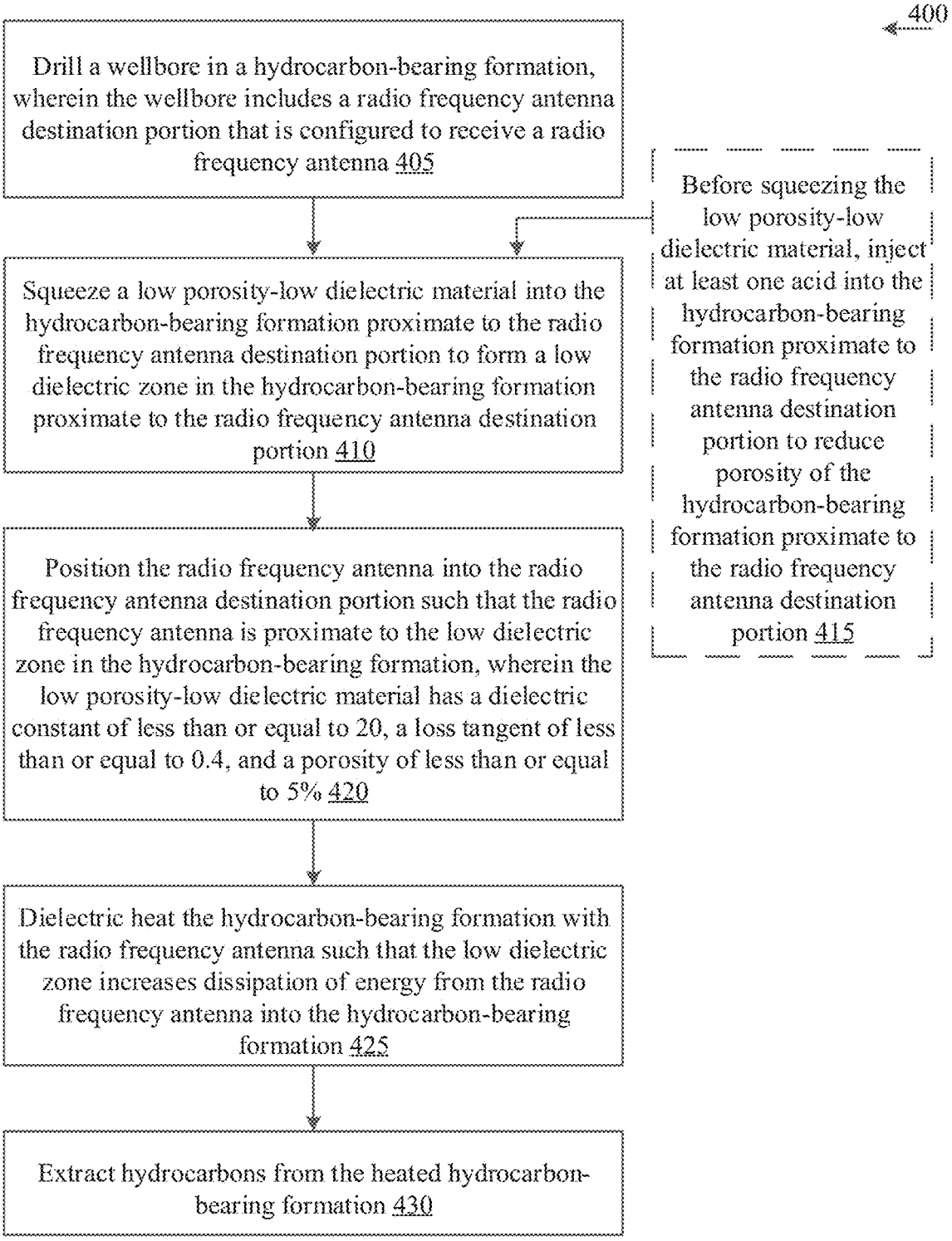
FIG. 4 illustrates another embodiment of a method of recovering hydrocarbons from a hydrocarbon-bearing formation using a radio frequency antenna.

FIG. 4 illustrates another embodiment of a method of recovering hydrocarbons from a hydrocarbon-bearing formation using a radio frequency antenna referred to as a method 400. Reference will be made to the embodiments illustrated in FIGS. 5A-5C and FIGS. 6A-6C, as appropriate, to facilitate understanding of the method 400.

Figure 5A:
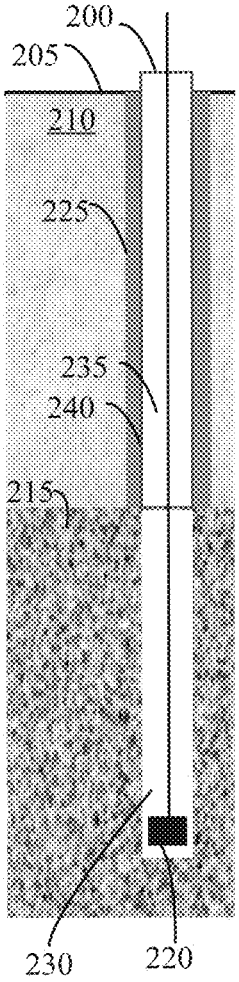
FIG. 5A illustrates, in cross-section, one embodiment of a wellbore that may be drilled per the squeezing based process described in FIG. 4.

At 405, the method 400 includes drilling a wellbore in a hydrocarbon-bearing formation. The wellbore includes a radio frequency antenna destination portion (e.g., in a horizontal portion or vertical portion of the wellbore) that is configured to receive a radio frequency antenna. The wellbore may have an inner diameter that is less than or equal to 15 inches (e.g., less than or equal to 9 inches in some embodiments). For example, as illustrated in FIG. 5A and explained in connection with FIG. 2A, the wellbore 200 may be drilled through the surface 205, through the overburden 210, and into the pay zone 215 that includes hydrocarbons. The wellbore 200 includes the radio frequency antenna destination portion 230, the remainder portion 235 with the casing 240, and the interior space inside the casing 240 that permits passage of fluid such as the low porosity-low dielectric material 250, equipment such as the radio frequency antenna 270, etc. The wellbore 200 may have an inner diameter that is less than or equal to 15 inches throughout the length of the wellbore 200, including throughout the length of the radio frequency antenna destination portion 230 and the remainder portion 235.

Figure 5B:
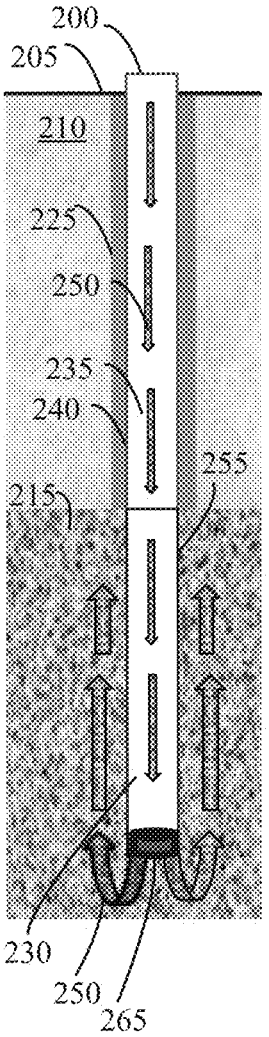
FIG. 5B illustrates, in cross-section, one embodiment of a low porosity-low dielectric material squeezed into a pay zone proximate to a radio frequency antenna destination portion of the wellbore of FIG. 5A.

At 410, the method 400 includes squeezing a low porosity-low dielectric material into the hydrocarbon-bearing formation proximate to the radio frequency antenna destination portion to form a low dielectric zone in the hydrocarbon-bearing formation proximate to the radio frequency antenna destination portion. For example, as illustrated in FIG. 5B, the low porosity-low dielectric material 250 may be pumped through the corresponding casing 240 of the remainder portion 235, through the corresponding casing 255 of the radio frequency antenna destination portion 230, out of the wellbore 200, and squeezed into the pay zone 215 proximate to the radio frequency antenna destination portion 230 to form the low dielectric zone 260 proximate to the radio frequency antenna destination portion 230. As discussed hereinabove, the casing 255 may be a low loss casing, such as a casing made of fiberglass or a casing made of a radio frequency transparent material. The low loss casing may have a dielectric constant of less than or equal to 20 in some embodiments. The low loss casing may have a dielectric constant of less than or equal to 10 in some embodiments. The low loss casing may have a loss tangent of less than or equal to 0.4 in some embodiments. The low loss casing may have a loss tangent of less than or equal to 0.3 in some embodiments.

Squeezing the low porosity-low dielectric material 250 involves the application of pump pressure to force said material through the float shoe 265 and into the pay zone 215 around the wellbore 200. In most cases, the squeeze treatment is performed at downhole injection pressure below that of the formation fracture pressure.

At 415, the method 400 may optionally include, before squeezing the low porosity-low dielectric material, injecting at least one acid into the hydrocarbon-bearing formation proximate to the radio frequency antenna destination portion to enlarge the pore spaces and increase permeability of the hydrocarbon-bearing formation proximate to the radio frequency antenna destination portion. In some embodiments, at least one acid may be injected before squeezing the low porosity-low dielectric material in order to enlarge the pore spaces and increase permeability in the hydrocarbon-bearing formation proximate to the radio frequency antenna destination portion. By doing so, the low porosity-low dielectric material may be squeezed more easily into the hydrocarbon-bearing formation proximate to the radio frequency antenna destination portion, and at lower pressures than the fracture pressure of the formation to form the low dielectric zone proximate to the radio frequency antenna destination portion. Examples of the acid include, but are not limited to: an acetic acid, a hydrochloric acid, a hydrofluoric acid, or any combination thereof. The acid injection involves the application of pump pressure to force said acid through the float shoe 265 and into the pay zone 215 around the wellbore 200. In most cases, the acid injection is performed at downhole injection pressure below that of the formation fracture. Whether to inject acid may depend on the type of hydrocarbon-bearing formation. For example, injection of acid may be beneficial for a carbonate-containing formation, as this type of formation may react rapidly in the presence of the acid. For example, the acid may be pumped through the corresponding casing 240 of the remainder portion 235, through the corresponding casing 255 of the radio frequency antenna destination portion 230, out of the wellbore 200, and squeezed into the pay zone 215 proximate to the radio frequency antenna destination portion 230.

Figure 5C:
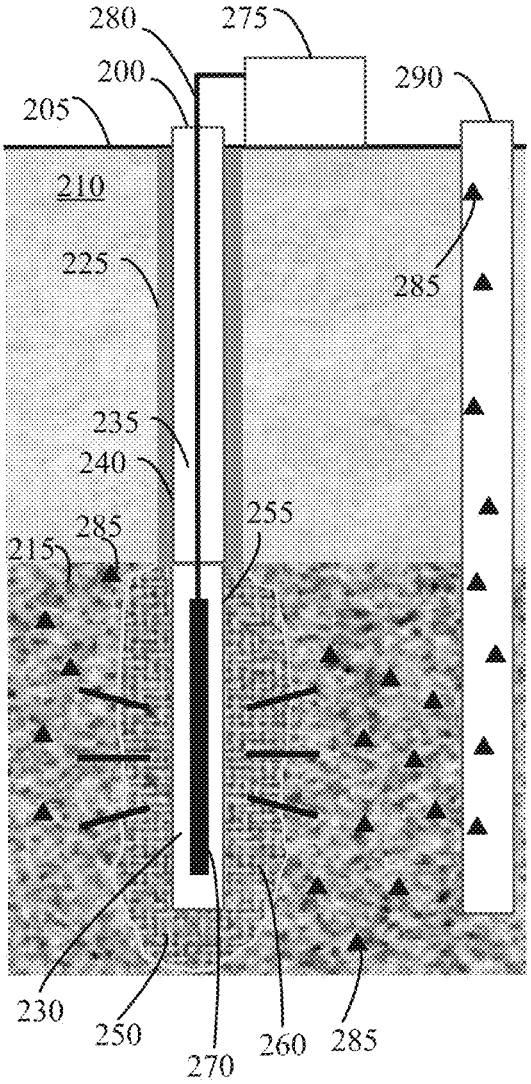
FIG. 5C illustrates, in cross-section, one embodiment of a low dielectric zone formed with the low porosity-low dielectric material of FIG. 5B and one embodiment of a radio frequency antenna in the low dielectric zone.

At 420, the method 400 includes positioning the radio frequency antenna into the radio frequency antenna destination portion such that the radio frequency antenna is proximate to the low dielectric zone in the hydrocarbon-bearing formation. For example, as illustrated in FIG. 5C and explained in connection with FIG. 2D, the radio frequency antenna 270 may be positioned into the radio frequency antenna destination portion 230 such that the radio frequency antenna 270 is surrounded by the casing 255 of the radio frequency antenna destination portion 230. By doing so, the radio frequency antenna 270 is also positioned proximate to the low dielectric zone 260 in the pay zone 215. As discussed hereinabove, the radio frequency antenna 270 may be coupled to the radio frequency generator 275 by at least one transmission line 280.

At 425, the method 400 includes dielectric heating the hydrocarbon-bearing formation with the radio frequency antenna such that the low dielectric zone increases dissipation of energy from the radio frequency antenna into the hydrocarbon-bearing formation. For example, as illustrated in FIG. 5C and explained in connection with FIG. 2D, the pay zone 215 may be dielectrically heated with the radio frequency antenna 270, and the low dielectric zone increases dissipation of the energy from the radio frequency antenna 270 into the pay zone 215, for example, to heat portions of the pay zone 215 that are farther away from the wellbore 200. Dielectric heating of the pay zone 215 by the radio frequency antenna 270 causes the hydrocarbons 285 in the pay zone 215 to also be heated, which reduces the viscosity of the hydrocarbons 285. The hydrocarbons 285 with lower viscosity are easier to extract from the pay zone 215. The dielectric heating operates to raise the temperature of the pay zone 215 from an initial temperature to at least a desired temperature greater than the initial temperature. However, the temperatures proximate to the radio frequency antenna 270 should be lower due to the presence of the low dielectric zone 260 as compared to temperatures proximate to the radio frequency antenna 270 without the presence of the low dielectric zone 260.

At 430, the method 400 includes extracting hydrocarbons from the heated hydrocarbon-bearing formation. For example, as illustrated in FIG. 5C and explained in connection with FIG. 2D, the hydrocarbons 285 of the pay zone 215, which has been dielectrically heated by the radio frequency antenna 270, may be extracted from the pay zone 215 using any technique and equipment (e.g., artificial lift system such as electric submersible pump, production tubing, etc.) known to those of ordinary skill in the art. In some embodiments, the hydrocarbons 285 flow towards at least one production wellbore 290, enter the production wellbore 290, and flow up the production wellbore 290 towards the surface 205 for further processing (e.g., separating of other fluids from the hydrocarbons 285, recycling of the other fluids, refining, transporting, etc.).

In some embodiments, dielectric heating with the radio frequency antenna 270 may be the only form of hydrocarbon recovery utilized to extract the hydrocarbons 285 from the pay zone 215. However, in some embodiments, dielectric heating with the radio frequency antenna 270 and at least one other form of hydrocarbon recovery (e.g., steam flooding) may be utilized to extract the hydrocarbons 285 from the pay zone 215.

Those of ordinary skill in the art will appreciate that modifications may be made to the squeezing based process, and the method 400 is not meant to limit the scope of the claims. For example, FIGS. 6A-6C illustrate some modifications. FIGS. 6A-6C are similar to FIGS. 5A-5C, except that FIGS. 6A-6C illustrate the radio frequency antenna destination portion 230 in a horizontal portion 600 of the wellbore 200. The wellbore 200, including the horizontal portion 600, may be drilled through the surface 205, through the overburden 210, and into the pay zone 215 that includes the hydrocarbons 285. The remainder portion 235 includes the casing 240, while the radio frequency antenna destination portion 230 in the horizontal portion 600 includes the casing 255. In some embodiments, the casing 255 may be a low loss casing, such as a casing made of fiberglass or a casing made of a radio frequency transparent material. Commercially available examples of the casing 255 may include the Star™ Aromatic Amine filament-wound fiberglass/epoxy casing from NOV Fiber Glass Systems, 17115 San Pedro Ave., Suite 200, San Antonio, Tex. 78232, USA. The wellbore 200 may have an inner diameter that is less than or equal to 15 inches throughout the length of the wellbore 200, including throughout the length of the radio frequency antenna destination portion 230 in the horizontal portion 600 and the remainder portion 235. As previously discussed, the low porosity-low dielectric material 250 may be pumped through the corresponding casing 240 of the remainder portion 235, through the corresponding casing 255 of the radio frequency antenna destination portion 230 in the horizontal portion 600, out of the wellbore 200, and squeezed into the pay zone 215 proximate to the radio frequency antenna destination portion 230 in the horizontal portion 600 to form the low dielectric zone 260 proximate to the radio frequency antenna destination portion 230. After the low dielectric zone 260 has been formed, the radio frequency antenna 270 may be positioned in the radio frequency antenna destination portion 230 in the horizontal portion 600 of the wellbore 200. The radio frequency antenna 270 may then be used for dielectric heating as previously discussed. An acid may also be utilized before squeezing as previously discussed.

As another example modification, the radio frequency antenna destination portion 230 (in a vertical portion of the wellbore as in FIGS. 5A-5C or in the horizontal portion 600 as in FIGS. 6A-6C) may not include the casing 255 in some embodiments. Instead, the tubing string 300 may pass through the casing 240 of the remainder portion 235, through the casing-less radio frequency antenna destination portion 230, and terminates at the float shoe 265. The tubing string 300 is used to squeeze the low porosity-low dielectric material 250 into the pay zone 215 proximate to the radio frequency antenna destination portion 230 to form the low dielectric zone 260 proximate to the radio frequency antenna destination portion 230. After the low dielectric zone 260 has been formed, the radio frequency antenna 270 may be positioned in the radio frequency antenna destination portion 230 and used for dielectric heating as previously discussed. An acid may also be utilized before squeezing as previously discussed.

Of note, due to the lack of casing 255, the radio frequency antenna destination portion 230 may become narrower than originally drilled. Moreover, due to the lack of casing 255, the low dielectric zone 260 may surround (and even contact) the radio frequency antenna 270, the transmission line 280, or any combination thereof. Also of note, if there is no casing 255 around the radio frequency antenna 270, then the radio frequency antenna 270 should be electrically insulated from the ground, for example, using a polymeric cover, electrically insulated painting, etc. Furthermore, if there is no casing 255 around the radio frequency antenna 270, then the radio frequency antenna 270 should also be protected from any hydrocarbons, water, fluids, or the like that are present in the formation.

As another example modification, the hydrocarbon-bearing formation, such as the pay zone 215, may be washed of conductive salts to a depth of a few inches (e.g., at least 5" to 6") away from the wellbore 200 (e.g., a 6" diameter wellbore). The washing may be started during the drilling process, and it may be finished by flushing the space between the casing 255 and the pay zone 215 with hot water (e.g., water heated to a temperature in a range of 40-90° C.), and then backfilled with a gelled hydrocarbon fluid (e.g., commercially available as the My-T-Oil$^{SM}$ service from Halliburton Company, 10200 Bellaire Blvd, Houston, Tex. 77072). The washing is meant to reduce the formation conductivity to less than 50 mS/m of the pay zone 215 proximate to the wellbore 200, and to maintain the low dielectric zone 260 during the duration of the dielectric heating. The washing may be performed before the squeezing in some embodiments. Both the washing and the acid injection (discussed at 415) may be performed before the squeezing in some embodiments.

EXAMPLES

The following illustrative examples are intended to be non-limiting. In each of the examples, a sample was placed into a sample holder (thickness of 3.5 mm-4.0 mm and 31 mm in diameter), placed in a dielectric test fixture, and connected to an Agilent Precision LCR meter, model E4980A, under computer control. The LCR meter is a type of electronic test equipment used to measure inductance (L), capacitance (C), and resistance (R) of an electronic component. The dielectric constant and loss tangent measurements were carried out following ASTM D 150 "Standard Test Methods for AC Loss Characteristics and Permittivity (Dielectric Constant) of Solid Electrical Insulation", which is incorporated by reference in its entirety. The porosity measurements were carried out following Smithson, T., Oilfield Review, Autumn 2012: 24, no. 3, 63, which is incorporated by reference in its entirety. The conditions for the measurements were: (a) frequency range: 1 kHz-2000 kHz, (b) temperature range: 20° C.-200° C., and (c) atmospheric pressure: 1 atmosphere.

Example 1

Figure 7:
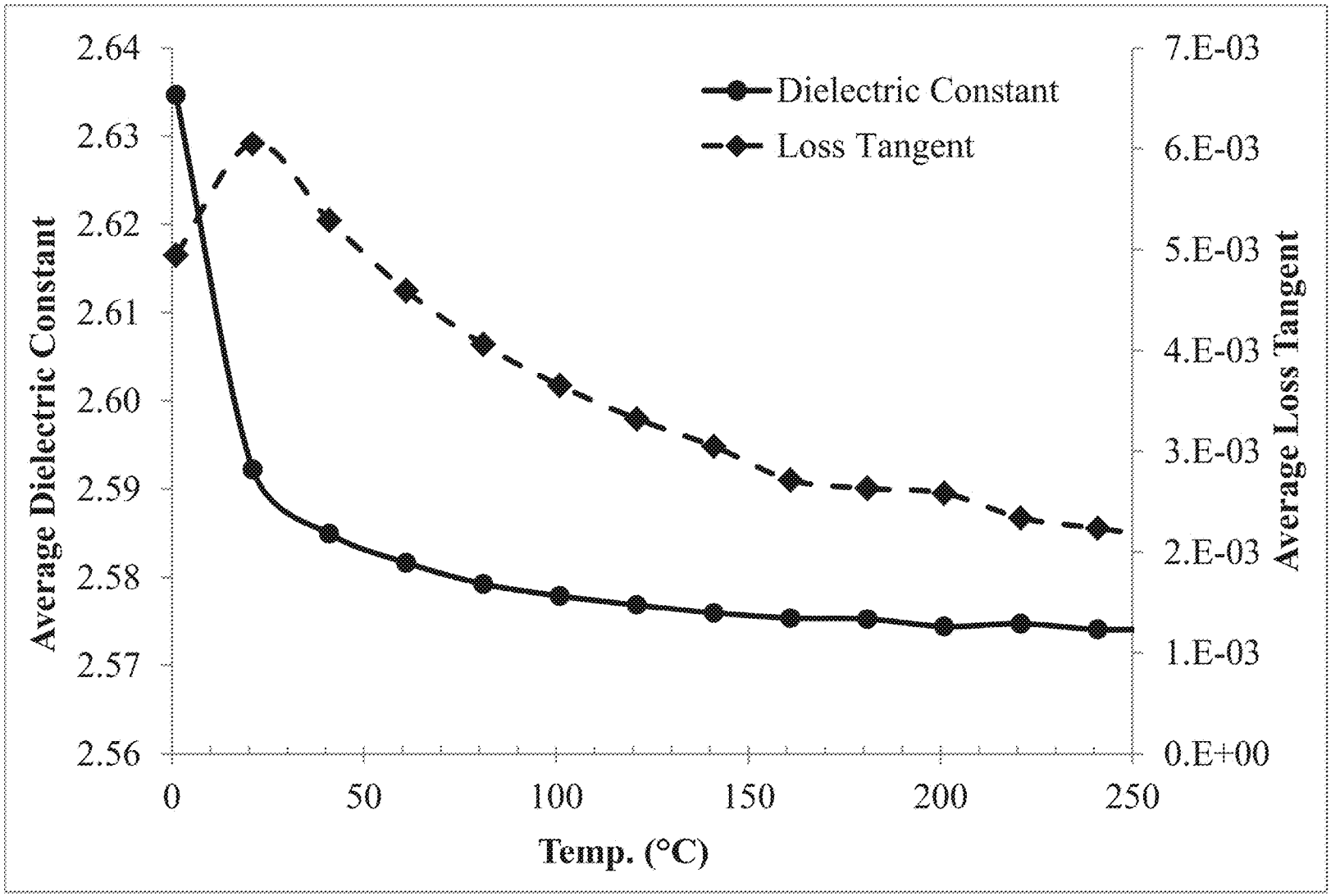
FIG. 7 illustrates a diagram of dielectric constant and loss tangent measurements for one example of a low porosity-low dielectric material.

A refinery-derived SDA tar was evaluated as a granulated solid and as a hydrocarbon containing material. The tar was placed in the sample holder, and the dielectric constant and the loss tangent were measured for the frequency range 1 kHz-2000 kHz at room temperature. As illustrated in FIG. 7, the dielectric constant and the loss tangent have values below 2.64 and 0.006 respectively, throughout the studied frequency range. The porosity was <1%. These values are well below the desired dielectric constant of less than or equal to 20, a loss tangent of less than or equal to 0.4, and a porosity of less than or equal to 5% for the low porosity-low dielectric material as discussed in the present disclosure.

Example 2

Figure 8:
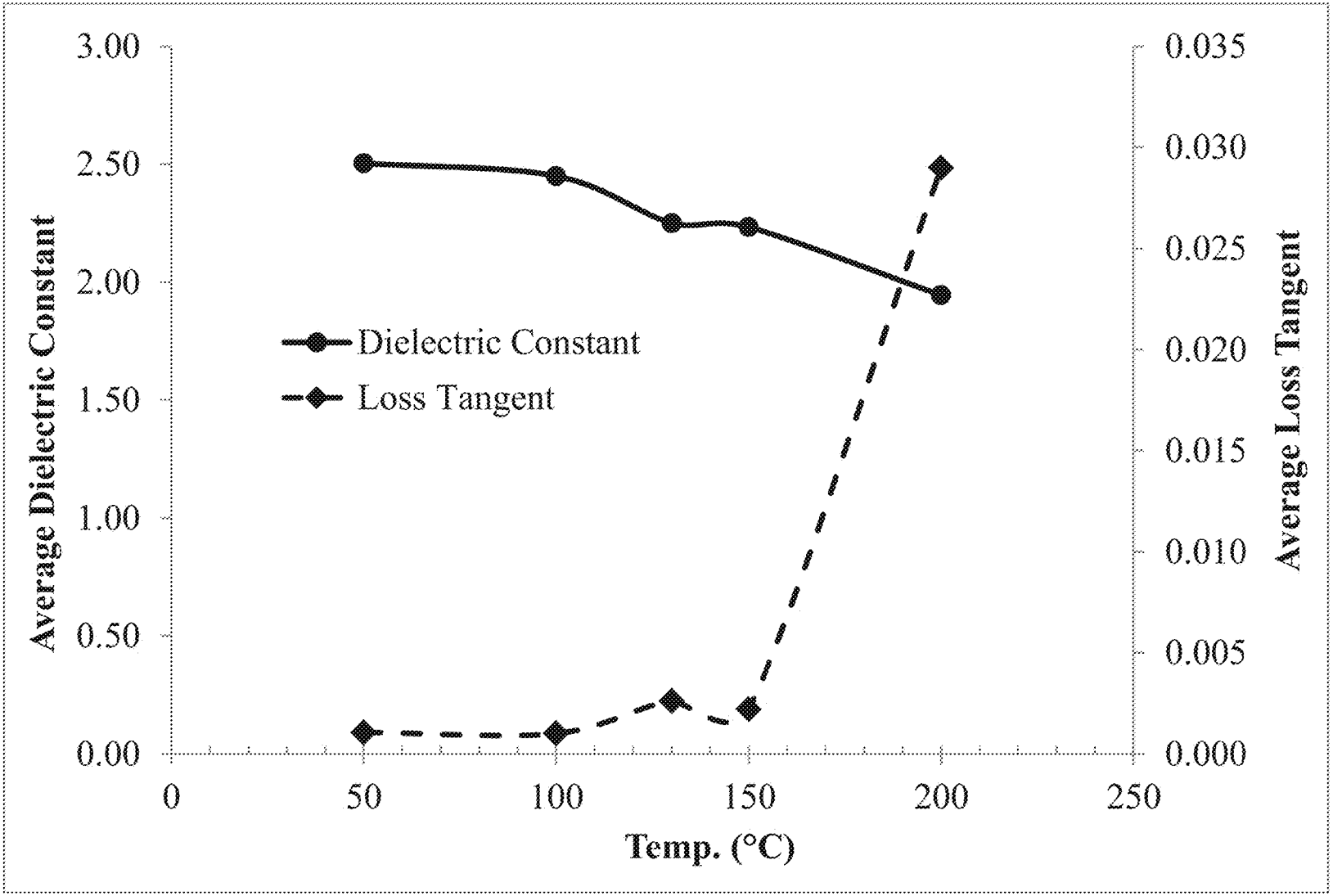
FIG. 8 illustrates a diagram of dielectric constant and loss tangent measurements for another example of a low porosity-low dielectric material.

A polydicyclopentadiene disk (made from a polydicyclopentadiene (pDCPD) resin commercially available as Telene™ 1650 from Telene S.A.S, Drocourt, France) having a thickness of 3.5 mm-4.0 mm and 31 mm in diameter was evaluated as a granulated solid. The disk was placed in the sample holder, and the dielectric constant and the loss tangent were measured for the frequency range 1 kHz-2000 kHz at the temperature range of 50° C. and 200° C. As illustrated in FIG. 8, the dielectric constant and the loss tangent have values below 3 and 0.030, respectively, throughout the studied frequency range. The porosity was <1%. These values are well below the desired dielectric constant of less than or equal to 20, a loss tangent of less than or equal to 0.4, and a porosity of less than or equal to 5% for the low porosity-low dielectric material as discussed in the present disclosure.

Example 3

A cement slurry was evaluated. The cement slurry was created by stirring 400 g of fresh water in a 1 L blender at 4,000 RPM while adding the following dry components: (a) Portland cement blend containing 35% wt. fine silica, (b) 15% wt. pozzolanic based hollow microspheres, (c) 5% wt. naturally occurring hydrocarbon based lost circulation material, (d) a defoamer, (e) a dispersant, (f) a thixotropic agent, and (g) a fluid loss control additive to give a density of 12 pounds per gallon (ppg). Then, the cement slurry was mixed at 12,000 RPM, poured into a cup, and heated to 110° F. in 10 minutes. Next, the cement slurry was poured into brass cylinder molds and heated to 110° F. in a water bath for 48 hours-72 hours. Different specimens of the cement slurry were aged in a brine solution (4000 ppm of NaCl equivalent) at 120° F. and one atmosphere for six weeks. At the end of the curing period, the heat was turned off. After 12 hours of cool down, the cylinders were removed and turned into wafers (thickness of 3.5 mm-4.0 mm and 31 mm in diameter) for dielectric constant and loss tangent measurements. The dielectric constant and the loss tangent have values below 19 and 0.15, respectively. The porosity was <1%. These values are well below the desired dielectric constant of less than or equal to 20, a loss tangent of less than or equal to 0.4, and a porosity of less than or equal to 5% for the low porosity-low dielectric material as discussed in the present disclosure.

Example 4

Figure 9:
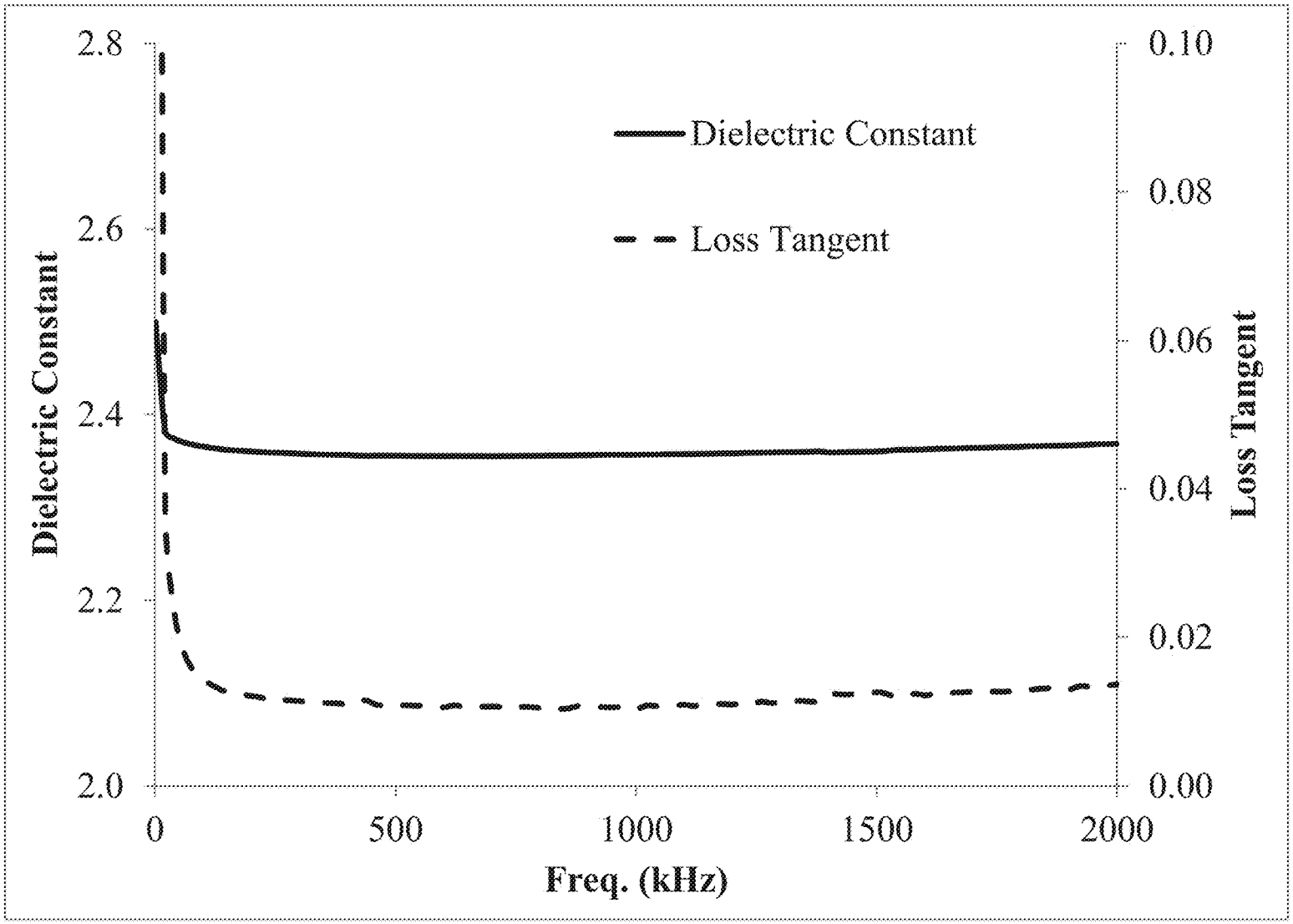
FIG. 9 illustrates a diagram of dielectric constant and loss tangent measurements for another example of a low porosity-low dielectric material.

Silicon dioxide containing sand particles such as Ottawa sand, commercially available from Fisher Scientific Cat. No. S23-3, was evaluated as a granulated solid. Specifically, the Ottawa sand (99% $SiO_2$, dried at 110° C. for 2 hours) was placed in the sample holder, and the dielectric constant and the loss tangent were measured for the frequency range 1 kHz-2000 kHz at room temperature. As illustrated in FIG. 9, the dielectric constant and the loss tangent have values below 2.5 and 0.10, respectively, throughout the studied frequency range. The porosity was <1%. These values are well below the desired dielectric constant of less than or equal to 20, a loss tangent of less than or equal to 0.4, and a porosity of less than or equal to 5% for the low porosity-low dielectric material as discussed in the present disclosure.

Example 5

Figure 10:
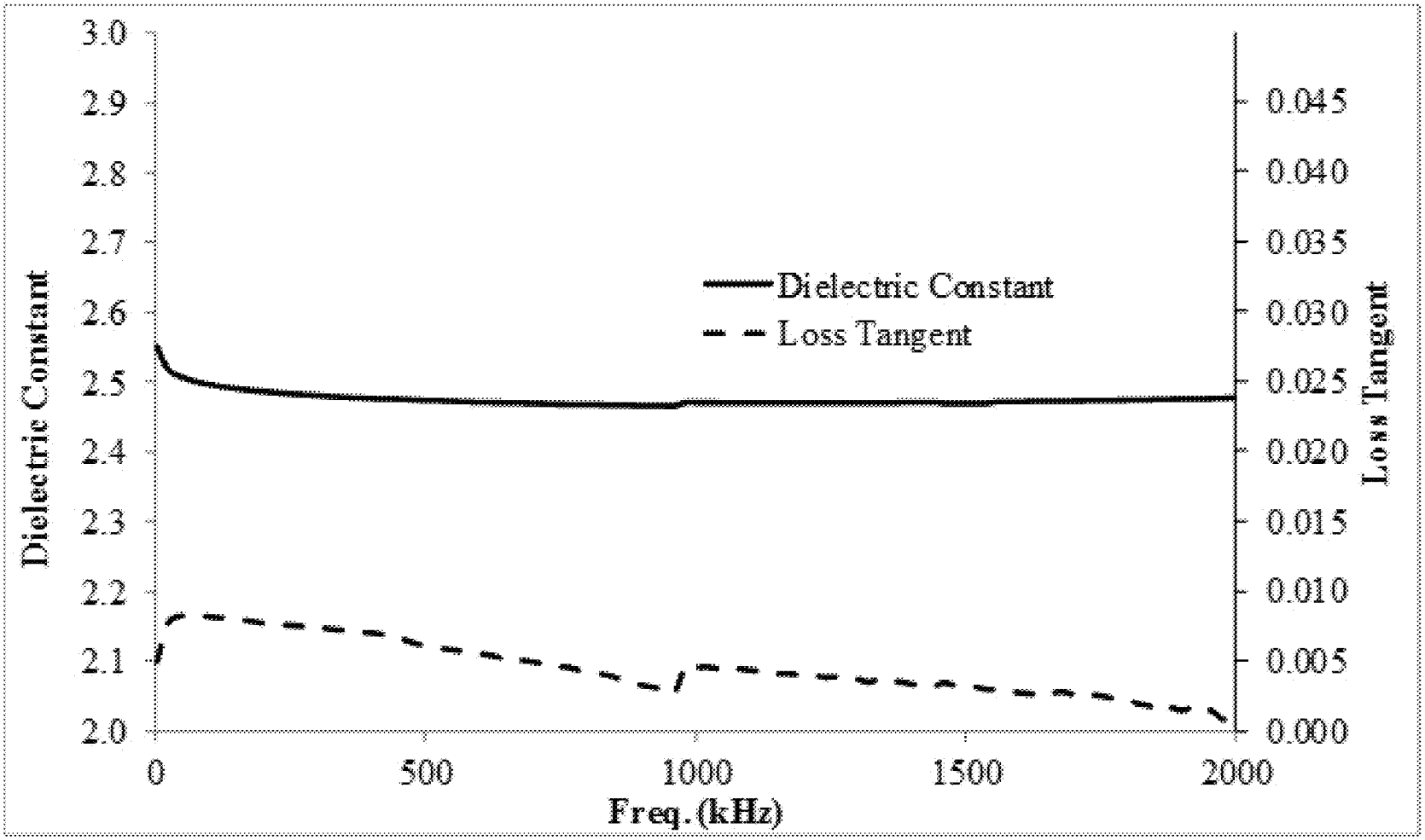
FIG. 10 illustrates a diagram of dielectric constant and loss tangent measurements for another example of a low porosity-low dielectric material.

An aromatic amine epoxy was prepared by mixing DER 332 (high purity diglycidyl ether of Bisphenol "A" from Sigma-Aldrich part number 31185) and 4,4'-methylenedianiline and evaluated as a binder. Specifically, 3.31 grams of DER 332 heated to 50° C. was mixed with 0.99 grams of 4,4'-methylenedianiline heated at 120° C. Furthermore, 4.30 grams of ground polydicyclopentadiene (pDCPD) resin commercially available as Telene™ 1650 from Telene S.A.S, Drocourt, France (evaluated as a granulated solid) was blended with the binder. The mixture was then placed in a Teflon mold and placed under compressive force at 100° C. for 1 hour and then 176° C. for 2 hours. The sample was then turned on a lathe to produce a disk that is 37.2 mm in diameter and 4.3 mm thick. The dielectric constant and the loss tangent were measured for the frequency range of 1 kHz-2000 kHz at 20° C. As illustrated in FIG. 10, the dielectric constant and the loss tangent have values below 2.6 and 0.01, respectively, throughout the studied frequency range. The porosity was <1%. These values are well below the desired dielectric constant of less than or equal to 20, a loss tangent of less than or equal to 0.4, and a porosity of less than or equal to 5% for the low porosity-low dielectric material as discussed in the present disclosure.

The description and illustration of one or more embodiments provided in this application are not intended to limit or restrict the scope of the invention as claimed in any way. The embodiments, examples, and details provided in this disclosure are considered sufficient to convey possession and enable others to make and use the best mode of claimed invention. The claimed invention should not be construed as being limited to any embodiment, example, or detail provided in this application. Regardless whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope. For instance, such other examples are intended to be within the scope of the claims if they have structural or methodological elements that do not differ from the literal language of the claims, or if they include equivalent structural or methodological elements with insubstantial differences from the literal languages of the claims, etc. All citations referred herein are expressly incorporated by reference.

The invention claimed is:

1. A method of recovering hydrocarbons from a hydrocarbon-bearing formation using a radio frequency antenna, the method comprising:

placing a low porosity-low dielectric material in a hydrocarbon-bearing formation proximate to a radio frequency antenna destination portion of a wellbore in the hydrocarbon-bearing formation to form a low dielectric zone, wherein the low porosity-low dielectric material has a dielectric constant in a range of 1 to 20, a loss tangent in a range of 0.00001 to 0.4, and a porosity in a range of 0% to 5%, and wherein placing the low porosity-low dielectric material in the hydrocarbon-bearing formation comprises squeezing the low porosity-low dielectric material into the hydrocarbon-bearing formation during a squeeze treatment;

positioning the radio frequency antenna into the radio frequency antenna destination portion such that the radio frequency antenna is proximate to the low dielectric zone in the hydrocarbon-bearing formation, wherein the radio frequency antenna is configured for dielectric heating in a frequency range of 1 kHz to 100 MHz;

dielectric heating the hydrocarbon-bearing formation with the radio frequency antenna in the frequency range of 1 kHz to 100 MHz such that the low dielectric zone increases dissipation of energy from the radio frequency antenna into the hydrocarbon-bearing formation; and extracting hydrocarbons from the heated hydrocarbon-bearing formation.

2. The method of claim 1, further comprising, before squeezing the low porosity-low dielectric material into the hydrocarbon-bearing formation, injecting at least one acid into the hydrocarbon-bearing formation proximate to the radio frequency antenna destination portion.

3. The method of claim 1, further comprising, before squeezing the low porosity-low dielectric material into the hydrocarbon-bearing formation, washing conductive salts away from the hydrocarbon-bearing formation proximate to the radio frequency antenna destination portion to reduce conductivity of the hydrocarbon-bearing formation proximate to the radio frequency antenna destination portion.

4. The method of claim 1, further comprising providing a tubing string in the wellbore and using the tubing string to deliver the low porosity-low dielectric material into the hydrocarbon-bearing formation proximate to the radio frequency antenna destination portion.

5. The method of claim 1, further comprising providing a low loss casing in the radio frequency antenna destination portion.

6. The method of claim 5, wherein the low loss casing has a dielectric constant of less than or equal to 20, and wherein the low loss casing has a loss tangent of less than or equal to 0.4.

7. The method of claim 1, wherein the radio frequency antenna destination portion does not include casing.

8. The method of claim 1, wherein the radio frequency antenna destination portion is located in a horizontal portion of the wellbore.

9. The method of claim 1, wherein the radio frequency antenna has a power density in a range of 1 kW to 12 kW per meter of antenna.

10. The method of claim 1, wherein the low porosity-low dielectric material has a dielectric constant in a range of 1 to 10, and wherein the low porosity-low dielectric material has a loss tangent in a range of 0.00001 to 0.3.

11. The method of claim 1, wherein the low porosity-low dielectric material comprises a granulated solid.

12. The method of claim 1, wherein the low porosity-low dielectric material comprises a binder.

13. The method of claim 1, wherein the low porosity-low dielectric material comprises a cement slurry and an additive.

14. The method of claim 1, wherein the low porosity-low dielectric material comprises a cement slurry, a foaming agent, and nitrogen.

15. The method of claim 1, wherein the low porosity-low dielectric material comprises a cement slurry, a foaming agent, nitrogen, and a low dielectric weighing agent.

16. The method of claim 1, wherein the low porosity-low dielectric material comprises a cement slurry and a hydrocarbon containing material.

17. The method of claim 1, further comprising drilling the wellbore in the hydrocarbon-bearing formation, wherein the wellbore includes the radio frequency antenna destination portion that is configured to receive the radio frequency antenna.

18. An apparatus for recovering hydrocarbons from a hydrocarbon-bearing formation, the apparatus comprising:

a radio frequency antenna adapted to be positioned in a radio frequency antenna destination portion of a wellbore in a hydrocarbon-bearing formation, wherein the radio frequency antenna is configured for dielectric heating in a frequency range of 1 kHz to 100 MHz;

a low porosity-low dielectric material that is positioned in the hydrocarbon-bearing formation proximate to the radio frequency antenna destination portion, wherein the low porosity-low dielectric material has a dielectric constant in a range of 1 to 20, a loss tangent in a range of 0.00001 to 0.4, and a porosity in a range of 0% to 5%, and wherein the low porosity-low dielectric material is positioned by squeezing the low porosity-low dielectric material into the hydrocarbon-bearing formation during a squeeze treatment; and wherein the low porosity-low dielectric material being capable of forming a low dielectric zone in the hydrocarbon-bearing formation when the radio frequency antenna is activated in the frequency range of 1 kHz to 100 MHz to increase the dissipation of energy from the radio frequency antenna into the hydrocarbon-bearing formation.

19. The method of claim 1, wherein the frequency range is 1 kHz-2000 kHz.

20. The method of claim 1, wherein the frequency range is 50 kHz 2 MHz.

21. The method of claim 1, wherein the frequency range is 5 kHz 20 MHz.

22. The apparatus of claim 18, further comprising a tubing string in the wellbore to deliver the low porosity-low dielectric material into the hydrocarbon-bearing formation proximate to the radio frequency antenna destination portion.

23. An apparatus for recovering hydrocarbons from a hydrocarbon-bearing formation, the apparatus comprising:

a radio frequency antenna adapted to be positioned in a radio frequency antenna destination portion of a wellbore in a hydrocarbon-bearing formation, wherein the radio frequency antenna is configured for dielectric heating in a frequency range of 1 kHz to 100 MHz;

a low loss casing is provided in the radio frequency antenna destination portion; and a low porosity-low dielectric material that is positioned in the hydrocarbon-bearing formation proximate to the radio frequency antenna destination portion, wherein the low porosity-low dielectric material has a dielectric constant in a range of 1 to 20, a loss tangent in a range of 0.00001 to 0.4, and a porosity in a range of 0% to 5%;

wherein the low porosity-low dielectric material being capable of forming a low dielectric zone in the hydrocarbon-bearing formation when the radio frequency antenna is activated in the frequency range of 1 kHz to 100 MHz to increase the dissipation of energy from the radio frequency antenna into the hydrocarbon-bearing formation.

24. The apparatus of claim 23, further comprising a tubing string in the wellbore to deliver the low porosity-low dielectric material into the hydrocarbon-bearing formation proximate to the radio frequency antenna destination portion.

* * * * *